US007596338B2

(12) United States Patent
Mihara

(10) Patent No.: US 7,596,338 B2
(45) Date of Patent: Sep. 29, 2009

(54) TONER CONTAINER, TONER FEED DEVICE AND IMAGE FORMING APPARATUS

(75) Inventor: Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 164 days.

(21) Appl. No.: 11/806,567

(22) Filed: Jun. 1, 2007

(65) Prior Publication Data

US 2008/0013983 A1 Jan. 17, 2008

(30) Foreign Application Priority Data

Jul. 13, 2006 (JP) ..... 2006-192516

(51) Int. Cl.
*G03G 15/08* (2006.01)

(52) U.S. Cl. ..... 399/106; 399/258

(58) Field of Classification Search ..... 399/106, 399/258, 262, 120, 103, 119, 102; 222/DIG. 1
See application file for complete search history.

(56) References Cited

U.S. PATENT DOCUMENTS 6,128,453 A * 10/2000 Ban et al. ..... 399/106
7,174,120 B2 2/2007 Koyama et al.
2005/0058471 A1* 3/2005 Nagahama et al. ..... 399/262
2005/0123323 A1 6/2005 Koyama et al.

FOREIGN PATENT DOCUMENTS

JP 56-130776 A 10/1981
JP 6-332311 A 12/1994
JP 2003-330256 A 11/2003
JP 2004-333854 11/2004
JP 2005-173052 A 6/2005

* cited by examiner

*Primary Examiner*—David M Gray
*Assistant Examiner*—Kristofferson Service
(74) *Attorney, Agent, or Firm*—Nixon & Vanderhye, P.C.

(57) ABSTRACT

A toner container for an image forming apparatus includes: a toner container body; structure supporting the container body in a rotatable manner and comprising a toner feed aperture. The supporting structure includes a shutter opening and closing mechanism for opening and closing the toner feed aperture. The container body is applied with a sealing element for sealing the toner discharge aperture of the container body. The sealing element is engaged with the supporting structure at one end opposite to the other end thereof which seals the toner discharge aperture of the container body when the container body is held by the supporting structure. The side surface of the container body against which the shutter opening and closing mechanism provided for the supporting structure abuts is formed with an engaging projection for engaging the shutter opening and closing mechanism when the shutter element confines the toner feed aperture.

18 Claims, 21 Drawing Sheets

TONER CONTAINER, TONER FEED DEVICE AND IMAGE FORMING APPARATUS

This Nonprovisional application claims priority under 35 U.S.C. §119(a) on Patent Application No. 2006-192516 filed in Japan on 13 Jul. 2006, the entire contents of which are hereby incorporated by reference.

BACKGROUND

Technical Field

An example embodiment of the present invention relates to a toner container for storing toner used for an image forming apparatus such as a copier, printer, facsimile machine and the like as well as to a toner feed device to which the toner container is removably attached and an image forming apparatus equipped with the toner feed device. The example embodiment particularly relates to a supporting structure for supporting the toner container.

In general, in an image forming apparatus such as a copier, printer, facsimile machine and a multifunctional machine at least including two functions of these, its output is produced by forming an electrostatic latent image on a photoreceptor, developing the electrostatic image on the photoreceptor with a developer that is fed from a developing unit to the photoreceptor to form a developer image on the photoreceptor, transferring the developer image from the photoreceptor to recording paper and heating and pressing the recording paper to fix the developer image to the recording paper.

In the developing unit, for example a dual component developer composed of a mixture of a toner and a magnetic carrier is agitated so as to tribo-electrify the toner, and the thus agitated dual-component developer is caused to adhere to a rotating developing roller so as to convey and supply the dual-component developer to the development area between the developing roller and photoreceptor, to thereby develop the electrostatic latent image on the photoreceptor with the toner from the dual-component developer. The developer roller is composed of a cylindrical sleeve and magnets arranged in the sleeve. The developer roller, as it is rotating its sleeve and attracting the dual-component developer to the sleeve surface by the magnetic field from the magnets in the sleeve, conveys and supplies the dual-component developer from the sleeve to the photoreceptor.

Further, since, in the developing unit, toner is consumed from the dual-component developer as electrostatic latent images on the photoreceptor are developed, toner has to be successively supplied by means of a toner feed device as the developer is consumed. This toner feed device includes an intermediate hopper (toner supply hopper) for temporarily storing the toner to be fed to the developing unit and supplying the necessary amount of toner to the developing unit and a toner container for storing toner mounted to the intermediate hopper. Provided in the portion where the toner container is mounted to the intermediate hopper is a mounting mechanism for allowing the toner container to be removably mounted to the intermediate hopper. This mounting mechanism is formed with a feed path for connecting the toner discharge port of the toner container with the intermediate hopper. In this way, toner is supplied from the toner feed device including a toner container such as a toner cartridge, toner bottle or the like, to the developing unit, and when almost all the toner in the toner container is used up, the toner container is replaced with a new one as appropriate by the user.

One configuration of such a toner container is disclosed in, for example, Japanese Patent Application Laid-open 2004-333854. This container is constructed such that its container body has projected pieces formed at its one end face with respect to the axial direction thereof, and is mounted to an image forming apparatus with the projected pieces engaged with a main-body side coupler so that a rotational drive force about the axis can be transferred to the container. The container body also has a refill port for charging the developer, formed at the same end face with respect to the axial direction and covered with a removable cap member so that the cap member is covered by the main body-side coupler when the projected pieces are coupled with the main body-side coupler. This toner container has a toner discharge aperture at the approximate center of the container body, and the approximately central portion of the container body including the portion where the toner discharge aperture is formed is supported by an approximately cylindrical supporting structure. This supporting structure has a toner feed aperture formed at the position corresponding to the toner discharge aperture of the container body. This toner feed aperture is provided with a shutter element that can open and close the opening in the lengthwise direction of the toner container. As the thus constructed toner container is rotated by a drive source provided for the main body side, the sealing sheet attached to the toner discharge port for preventing toner leakage is removed so that toner in the toner container is discharged through the toner discharge port, passes through the toner feed aperture of the supporting structure to be supplied to the intermediate hopper.

However, there is a risk that the container body supported by the supporting structure is erroneously rotated by unexpected impacts, vibrations and the like during shipment and transportation of the toner container. That is, this configuration entails the problem that the sealing sheet that has been attached to the toner discharge port comes off and the user's hands and clothes and the like are dirtied by leakage and scatter of toner in the toner container before the toner container is mounted to the toner feed device.

SUMMARY

An example embodiment has been devised in view of the above problem entailed with the conventional toner container and toner feed device, it is therefore an object of the example embodiment to provide a new and improved toner container, toner feed device and image forming apparatus, with which the toner container can be prevented from rotating before it is mounted to the toner feed device and used therein.

In order to achieve the above object, one aspect of the example embodiment provides a toner container that is removably attached to a toner feed device for feeding toner to a developing unit provided for an image forming apparatus, comprising:

a container body including a toner storing portion filled with toner, and a toner discharge aperture arranged in a toner feed recess formed on the outer peripheral surface of the toner storing portion for discharging toner from the toner storing portion by rotationally driving the toner storing portion about the axis thereof as a rotary axis; and a supporting structure, which supports the container body in a rotatable manner by enclosing the outer peripheral surface along the rotational direction of the container body so as to include the area where the toner feed recess is formed, and has a toner feed aperture for feeding the toner discharged from the toner discharge aperture into the toner feed recess, to the outside, characterized in that the supporting structure includes a shutter opening and closing mechanism having an approximately plate-like shutter element that is movable along a fixed direction for opening and closing the toner feed aperture;

the container body is applied with a sealing element for sealing the toner discharge aperture;

the sealing element is engaged with the supporting structure at one end opposite to the other end thereof which seals the toner discharge aperture when the container body is held by the supporting structure; and, the side surface of the container body against which the shutter opening and closing mechanism provided for the supporting structure abuts is formed with an engaging projection for engaging the shutter opening and closing mechanism when the shutter element confines the toner feed aperture.

Since, with the above configuration, the engaging projection formed on the container body is engaged with the shutter opening and closing mechanism that is closing the toner feed aperture, it is possible to prevent the container body supported by the supporting structure from being erroneously rotated by unexpected impacts, vibrations and the like during shipment and transportation of the toner container, hence it is possible to prevent the sealing element adhering to the toner discharge port of the container body from coming off and hence prevent toner leakage and scattering inside the toner container.

Also in the above example embodiment, the sealing element may be formed of a material having air permeability and hygroscopicity.

With this configuration, it is possible to eliminate the difference in pressure between the interior and exterior of the container body of the toner container and also to prevent the toner inside the container body from being exposed to moisture. As a result, it is possible to prevent toner from scattering due to pressure difference between the interior and exterior of the container when toner is discharged from the container body of the toner container and also to maintain the toner inside the container in a constant dried condition, hence keep the quality of the toner inside the container.

Another aspect of the example embodiment in order to solve the above problem provides a toner feed device comprising: a toner container including a container body filled with toner and a supporting structure for supporting the container body in a rotatable manner; and an intermediate hopper which has the toner container attached thereto, temporarily stores the toner discharged from the toner feed aperture of the toner container as the container body is rotationally driven about the axis thereof as a rotational axis and supplies the toner to a developing unit provided for an image forming apparatus, wherein any one of the above toner containers is removably mounted.

Since the engaging projection formed on the container body is engaged with the shutter opening and closing mechanism that is closing the toner feed aperture, this configuration makes it possible to prevent the container body supported by the supporting structure from being erroneously rotated by unexpected impacts, vibrations and the like during shipment and transportation of the toner container, hence enables easy mounting without causing any toner leakage when the toner container is mounted to the toner feed device, thus contributing to improvement in workability and maintenance performance.

In the above aspect, it is possible to adapt a rotational load to be applied to the container body when the container body is rotated to supply toner by releasing the shutter element, retracting the engaging projection from the shutter opening and closing mechanism.

With this configuration, it is possible to prevent the container body from being easily rotated by external force such as human strength or the like even when the shutter opening and closing mechanism is broken or in any other anomaly condition. As a result it is possible to prevent the sealing element that is being applied to the toner discharge aperture of the container body from peeling off before the toner container is used, thus improving the toner container in maintenance performance.

As described heretofore, according to the example embodiment, since it is possible to prevent the container body of the toner container from being rotated before the toner container is set to the toner feed device and used, it is possible to prevent toner leakage, scattering and the like inside the toner container due to removal of the sealing element being adhered to the toner discharge port of the container body as a result of unexpected impacts, vibrations and the like. Accordingly, this configuration facilitates the user to handle the toner container without causing toner leakage when the user handles the toner container alone such as during hand carriage. As a result, improvement in workability and maintenance performance can be expected without dirtying the user, image forming apparatus etc., with toner spilling out of the toner container.

DESCRIPTION OF THE PREFERRED EXAMPLE EMBODIMENTS

Figure 1:
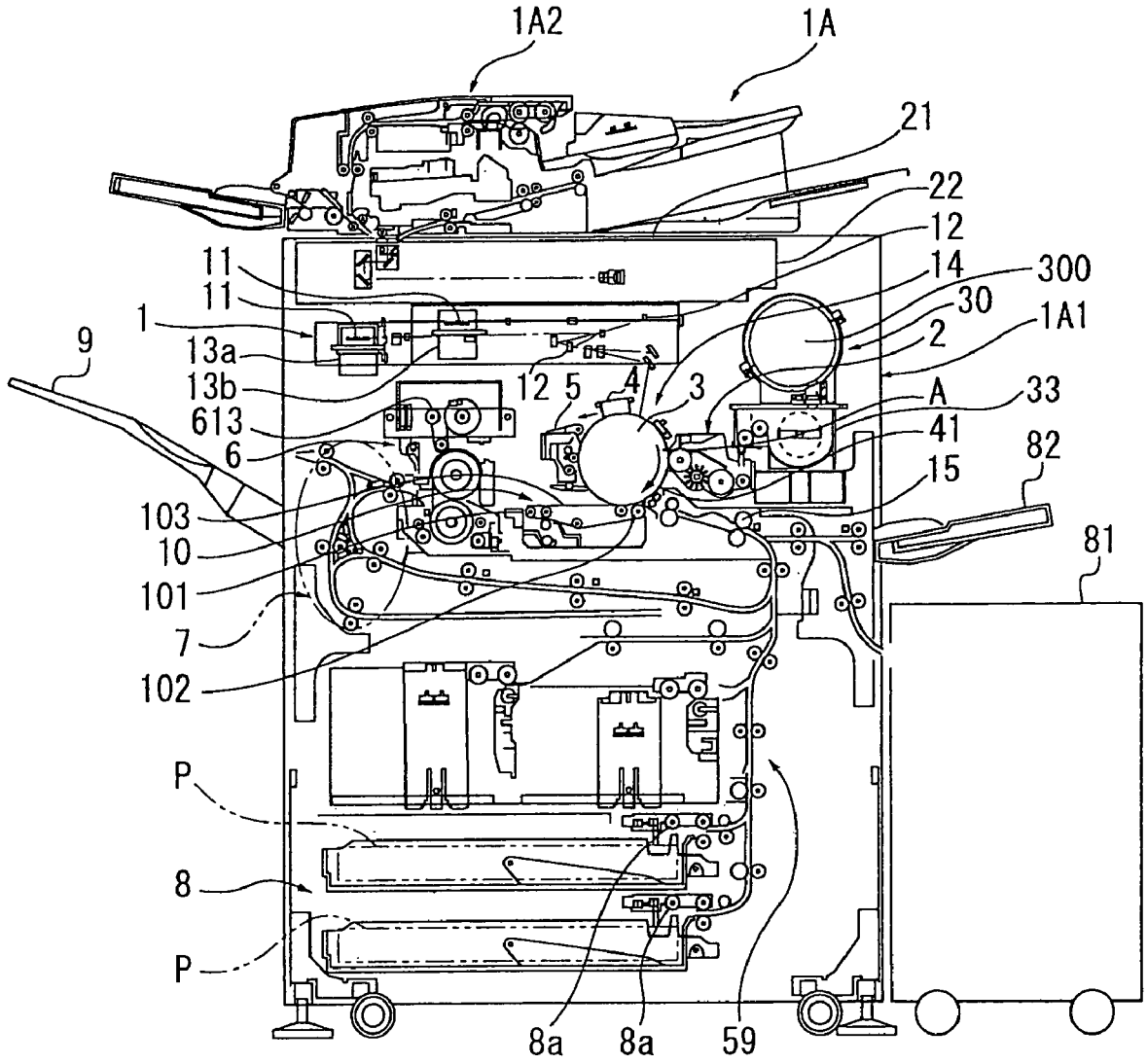
FIG. 1 is an illustrative view showing an overall configuration of the first example embodiment of an image forming apparatus in which a toner container according to the present example embodiment is used.

A preferred example embodiment will hereinafter be described in detail with reference to the accompanying drawings. Here in this specification and drawings, the components having essentially the same functions are allotted with the same reference numerals so that repeated description will be omitted.

The First Example Embodiment

Figure 2:
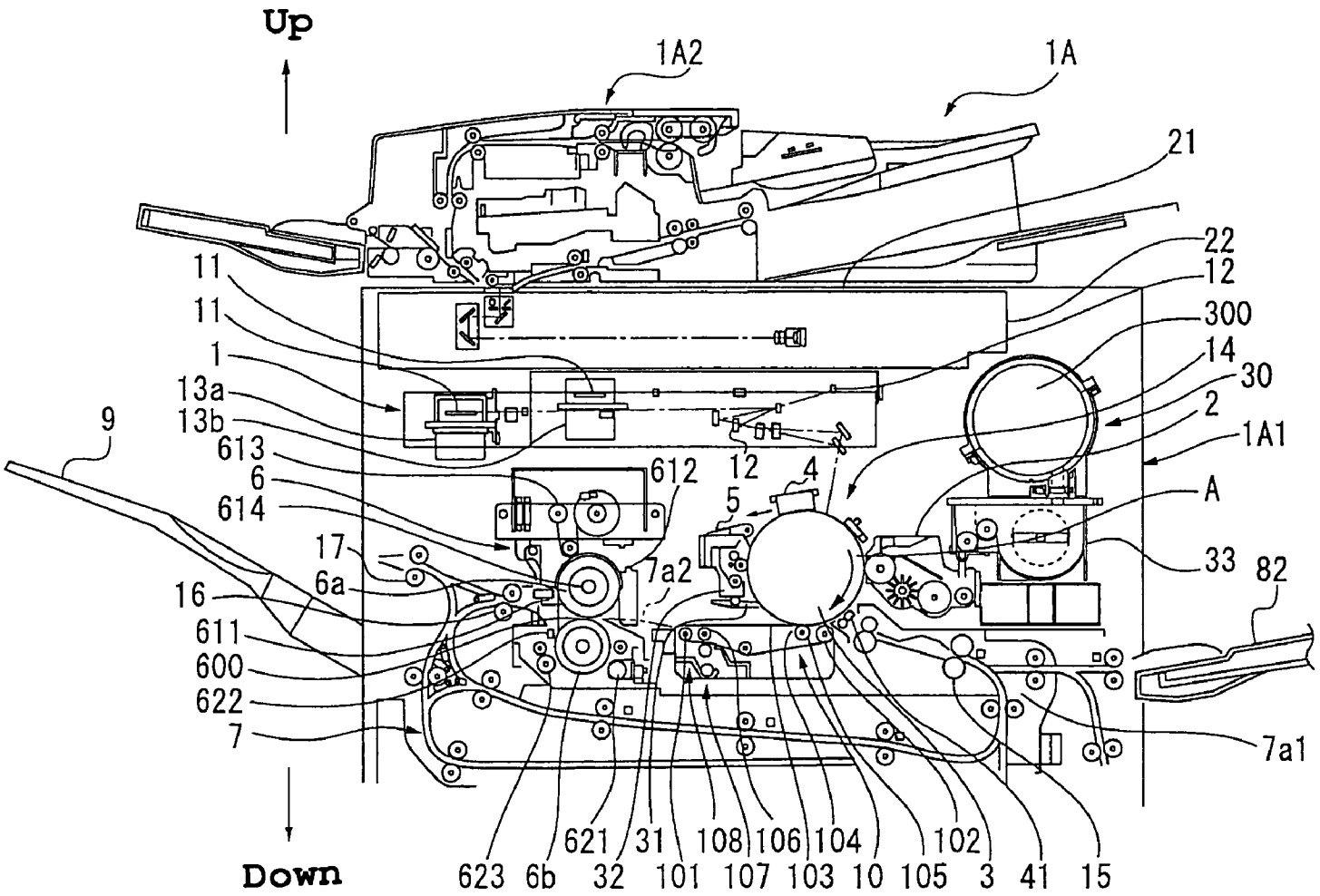
FIG. 2 is a partial detailed view showing the configuration of the apparatus body of the image forming apparatus in the example embodiment.

To being with, the configuration of the first example embodiment of an image forming apparatus in which a example embodiment toner container is used will be described with reference to the drawings. FIG. 1 is an illustrative view showing an overall configuration of the first example embodiment of an image forming apparatus in which a toner container according to the present example embodiment is used, and FIG. 2 is a partial detailed view showing the configuration of the apparatus body of the same image forming apparatus.

An image forming apparatus 1A in which a toner container according to the present example embodiment is used is an image forming apparatus that forms and outputs a monochrome image of image data that was captured by a scanner or the like or image data that was transferred from without, on a predetermined sheet of recording material (to be referred to hereinbelow as paper) as a recording medium, by electrophotography. This image forming apparatus 1A includes a paper feed tray 8 which can stack multiple sheets of paper P thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed onto the paper. The image forming apparatus, based on the conveying speeds of paper P corresponding to a multiple number of preset printout processing modes, can select and control the conveying speed of paper P in accordance with a print request and feed paper P from paper feed tray to a paper output tray 9.

Image forming apparatus 1A is essentially composed of, as shown in FIG. 1, an apparatus body 1A1 including a light exposure unit 1, a developing unit 2, a toner feed device 30, a photoreceptor drum 3, a charger 4, a charge erasing device 41, a cleaner unit 5, a fixing unit 6, paper conveyor system 7, a paper feed paths 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on top of this original placement table 21 so that it can pivotally open upwards while a scanner portion 22 as a document reader for reading image information of originals is laid out under this original placement table 21.

Figure 3:
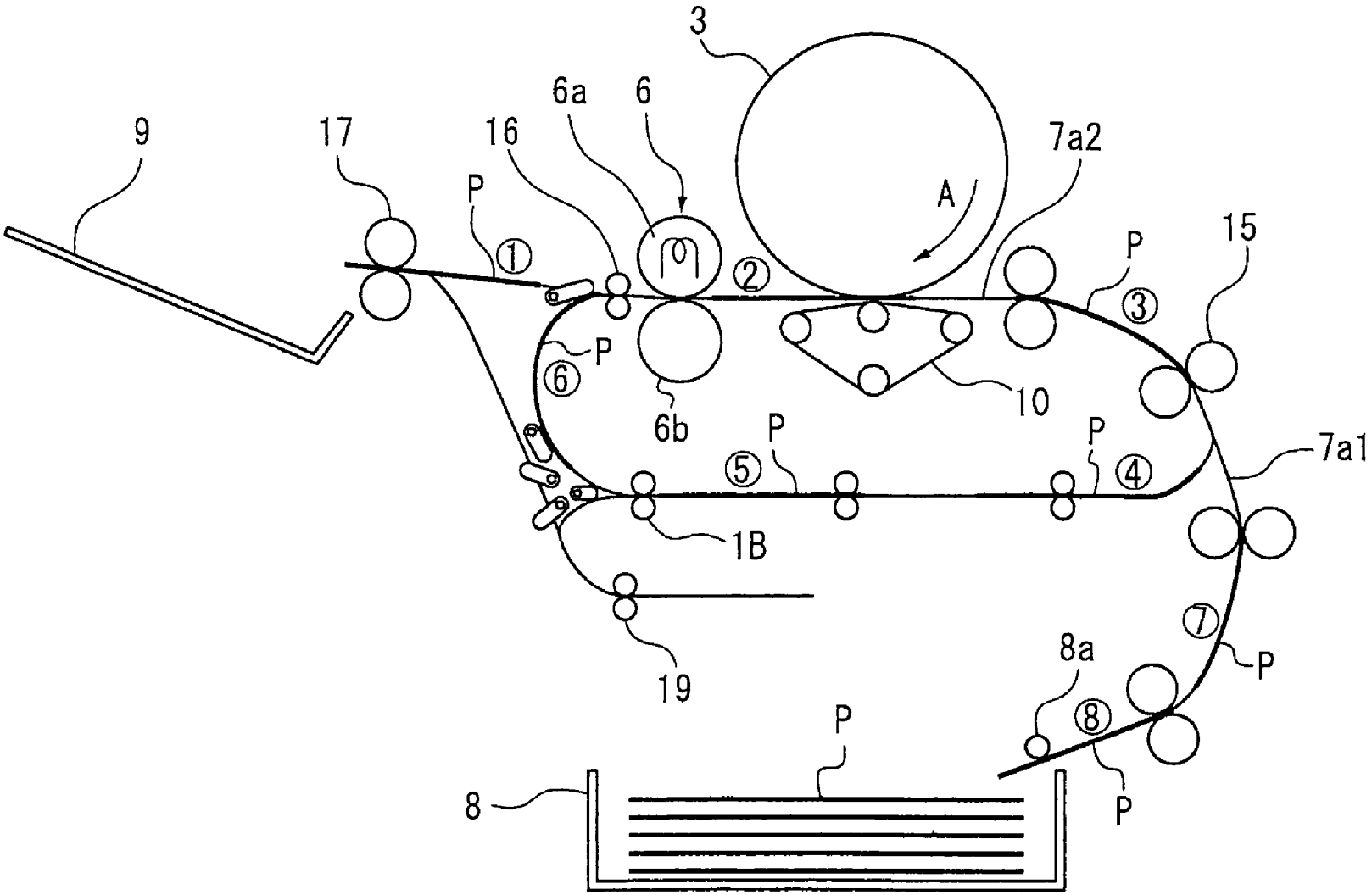
FIG. 3 is an illustrative view showing the configuration of paper feed paths in the image forming apparatus according to the same example embodiment.
Figure 4:
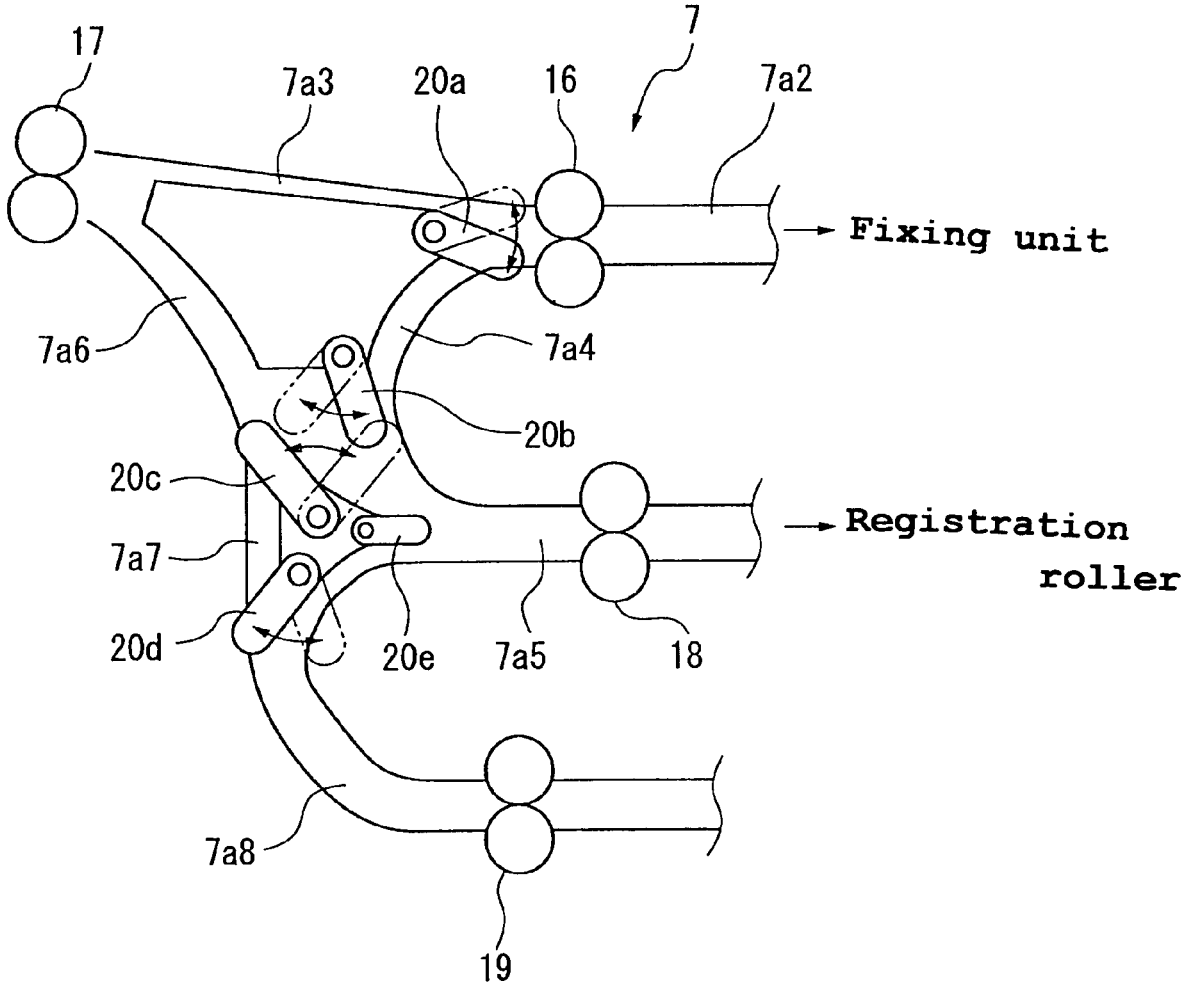
FIG. 4 is a partial detailed view showing the configuration of branched paper feed paths for the paper feed paths and branch guides for connection therebetween shown in FIG. 3.

Arranged below scanner portion 22 are light exposure unit 1, developing unit 2, photoreceptor drum 3, charger 4, charge erasing device 41, cleaner unit 5, fixing unit 6, paper conveyor system 7, paper feed paths 7*a* (7*a*1 to 7*a*8: FIGS. 3 and 4), paper output tray 9 and transfer device 10. Further, paper feed tray 8 that accommodates paper P is arranged under these.

Light exposure unit 1 provides a function of emitting laser beam in accordance with the image data output from an unillustrated image processor to irradiate the photoreceptor drum 3 surface that has been uniformly charged by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* each having a laser emitter 11 and a reflection mirror 12. In the present example embodiment, in order to achieve high-speed printing operation, a method for alleviating the rush of irradiation timings by using a multiple number of laser beams, namely a two-beam method, is adopted. Here, in the present example embodiment laser scanning units (LSUs) 13*a* and 13*b* are used for light exposure unit 1, but an array of light emitting elements, e.g., an EL or LED writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged starting from the position at which image transfer ends downstream in the rotational direction of the photoreceptor drum along the peripheral surface of this photoreceptor drum 3 are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper. Here, as a drive means for paper separation claw 31, a drive motor or the like may be used instead of solenoid 32, or any other drive means may be also selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium feed direction.

Toner feed device 30 temporarily holds the toner discharged from a toner container 300 filled with toner, in an intermediate hopper 33 and then supplies it to developing unit 2. This toner feed device is arranged adjacent to developing unit 2. Details of toner feed device 30 will be described later.

Registration roller 15 is operated and controlled by an unillustrated drive means and control means so as to convey the paper P delivered from paper feed tray 8 into and between photoreceptor drum 3 and a transfer belt 103 whilst making the leading end of the paper P register with the toner image on the photoreceptor drum 3.

Charger 4 is a charging means for uniformly charging the photoreceptor drum 3 surface at a predetermined potential, and is arranged over photoreceptor drum 3 and close to the outer peripheral surface thereof. Here, a discharge type charger 4 is used in the present example embodiment, but a contact roller type or a brush type may be used instead.

Charge erasing device 41 is a pre-transfer erasing means for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same. Though in the present example embodiment, charge erasing device 41 is configured using a charge erasing electrode, a charge erasing lamp or any other method can be used instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed as transfer device 10 applies an electric field having an opposite polarity to that of the electric charge of the electrostatic image. For example, when the electrostatic image bears negative (−) charge, the applied polarity of transfer device 10 should be positive (+).

Transfer device 10 is provided as a transfer belt unit form in which a transfer belt 103 having a predetermined resistivity (ranging from $1\times10^{9}$ to $1\times10^{13}\Omega\cdot$cm in the example embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3. An elastic conductive roller 105 having a conductivity different from that of drive roller 101 and driven roller 102 and capable of applying a transfer electric field is laid out at a contact point 104 (FIG. 2) where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 (FIG. 2) for erasing the electric field that has been applied to the paper P being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P. Fixing unit 6 includes a heat roller 6*a* and a pressing roller 6*b* as shown in FIG. 2 and fuses and fixes the toner image transferred on paper P by rotating heat roller 6*a* so as to convey the paper held between heat roller 6*a* and pressing roller 6*b* through the nip between heat roller 6*a* and pressing roller 6*b*. Arranged on the downstream side of fixing unit 6 with respect to the direction of paper conveyance is a conveyance roller 16 for conveying paper P.

Heat roller 6*a* has a sheet separation claw 611, a thermistor 612 as a roller surface temperature detector and a roller surface cleaning member 613, all arranged on the outer periphery thereof and a heat source 614 for heating the heat roller surface at a predetermined temperature (set fixing temperature: approximately 160 to 200 deg. C.) provided in the interior part thereof. Pressing roller 6*b* is provided at its each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by the anchoring effect to the paper P by the pressing force from heat roller 6*a* and pressing roller 6*b*.

Paper feed tray 8 (FIG. 1) stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper part on the paper delivery side of this paper feed tray 8.

This paper pickup roller 8*a* picks up paper P, sheet by sheet, from the topmost of a stack of paper stored in paper feed tray 8, and conveys the paper downstream (for convenience' sake, the delivery side of paper P (the cassette side) is referred to as upstream and the paper output side is referred to as downstream) to the registration roller (also called "idle roller") 15 side in paper feed path.

Since the image forming apparatus 1A according to the present example embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged on the top of the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and other processes and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feed path 7*a* provided for paper conveyor system 7, to transfer device 10, where a toner image is transferred from photoreceptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present example embodiment, two predetermined paper output processing modes, namely, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Now, paper feed path 7*a* provided for paper conveyor system 7 will be described in detail with reference to the drawings. FIG. 3 is an illustrative view showing the configuration of paper feed paths in the image forming apparatus according to the present example embodiment; and FIG. 4 is a partial detailed view showing the configuration of branched paper feed paths for the paper feed paths and branch guides for connection therebetween.

As shown in FIGS. 3 and 4, paper conveyor system 7 is essentially composed of a first paper feed path 7*a*1 extending from paper feed tray 8 to registration roller 15, a second paper feed path 7*a*2 extending from registration roller 15 and passing through transfer device 10 and fixing unit 6 to a conveyance roller 16 on the downstream side, a third paper feed path 7*a*3 extending from conveyance roller 16 to a paper discharge roller 17 for discharging paper to paper output tray 9, a fourth paper feed path 7*a*4 (FIG. 4) for inverting paper P from conveyance roller 16, a fifth paper feed path 7*a*5 (FIG. 4) connected to fourth paper feed path 7*a*4 and extending to an inversion conveyance roller 18 for re-feeding paper P to registration roller 15, a sixth paper feed path 7*a*6 (FIG. 4) for conveying paper P in reverse from paper discharge roller 17, a seventh paper feed path 7*a*7 (FIG. 4) connected to the sixth paper feed path and avoiding entrance to fifth paper feed path 7*a*5 and an eighth paper feed path 7*a*8 (FIG. 4) connected to seventh paper feed path 7*a*7 and extending to a switchback roller 19.

Here, inside paper feed paths 7*a* a multiple number of paper P can occupy depending on the processing mode. In the present example embodiment, eight sheets of paper P may be present at locations (1) to (8) (represented by encircled numerals in the drawing) in paper feed paths 7*a*, as shown in FIG. 3. The number of paper P permissible to be present in the paper feed paths can be different depending on the paper feed path configuration. Further, a plurality of branch guides for switching the route of paper P's conveyance by selecting the paper feed path in accordance with the selected processing mode are arranged at branch points.

As shown in FIG. 4, a branch guide 20*a* that selects connection to third paper feed path 7*a*3 or fourth paper feed path 7*a*4 is pivotably arranged at a point downstream of conveyance roller 16. This branch guide 20*a* is operated by an unillustrated solenoid. This branch guide 20*a* is adapted to operate by an unillustrated solenoid.

A branch guide 20*b* that connects fourth paper feed path 7*a*4 with fifth paper feed path 7*a*5 or fifth paper feed path 7*a*5 with sixth paper feed path 7*a*6 is pivotably arranged on the downstream side of fourth paper feed path 7*a*4. This branch guide 20*b* is operated by the elastic force of an unillustrated spring member and the rigidity of paper P.

A branch guide 20*c* that selects connection to fifth paper feed path 7*a*5 or seventh paper feed path 7*a*7 is pivotably arranged on the downstream side of sixth paper feed path 7*a*6. This branch guide 20*c* is adapted to operate by an unillustrated solenoid.

A branch guide 20*d* that connects seventh paper feed path 7*a*7 with eighth paper feed path 7*a*8 or fifth paper feed path 7*a*5 with eighth paper feed path 7*a*8 is pivotably arranged on the downstream side of seventh paper feed path 7*a*7. This branch guide 20*d* is adapted to operate by an unillustrated solenoid.

A branch guide 20*e* for assuring smooth connection from fourth paper feed path 7*a*4 or eighth paper feed path 7*a*8 to fifth paper feed path 7*a*5 is pivotably arranged on the upstream side of fifth paper feed path 7*a*5.

With the thus configured paper feed path 7, branch guides 20*a* to 20*d* are operated in accordance with the requested processing mode, whereby it is possible to select a conveyance route of paper P corresponding to the processing mode.

Figure 5:
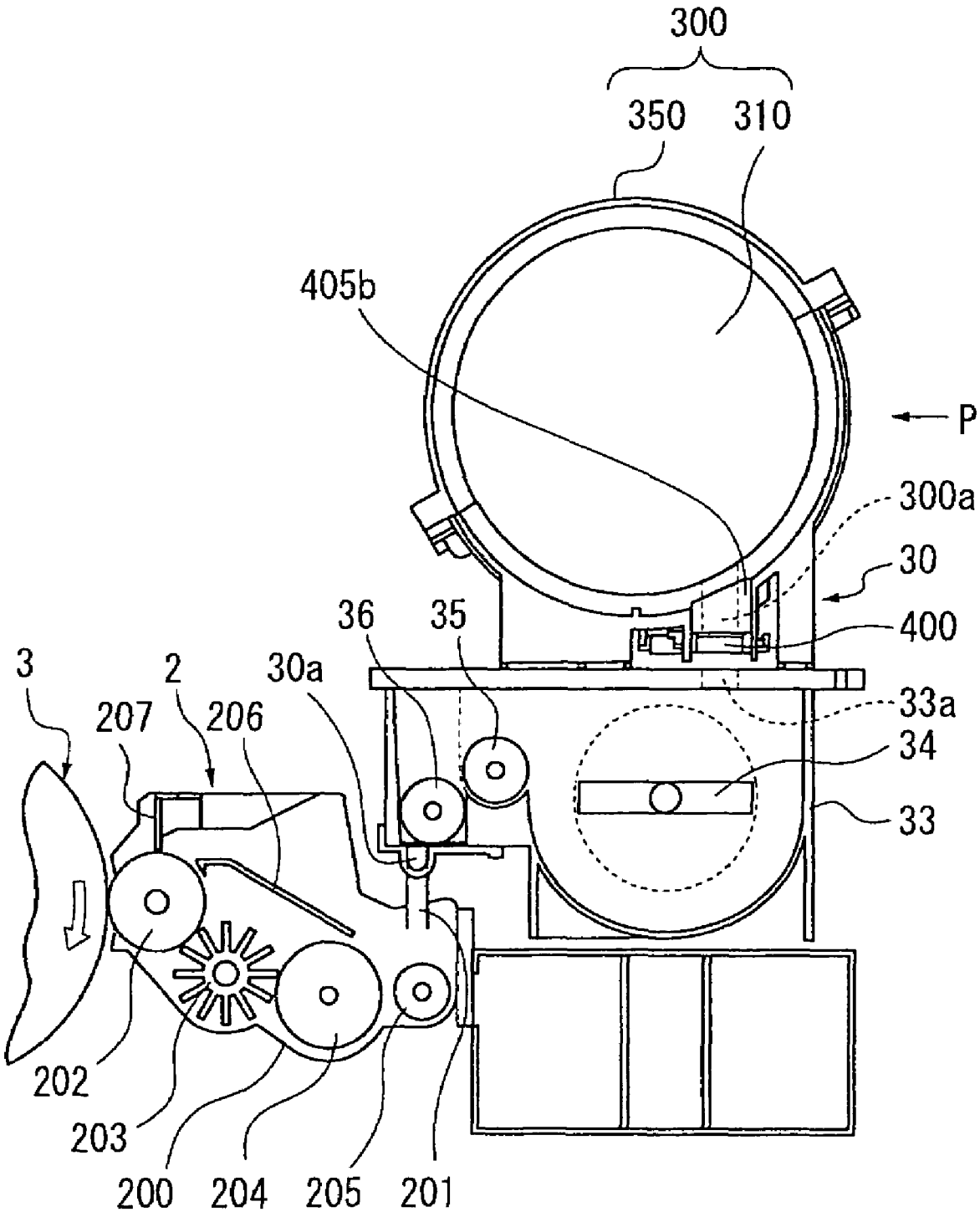
FIG. 5 is an overall sectional side view showing a developing unit and toner feed device provided for the image forming apparatus according to the same example embodiment.
Figure 6:
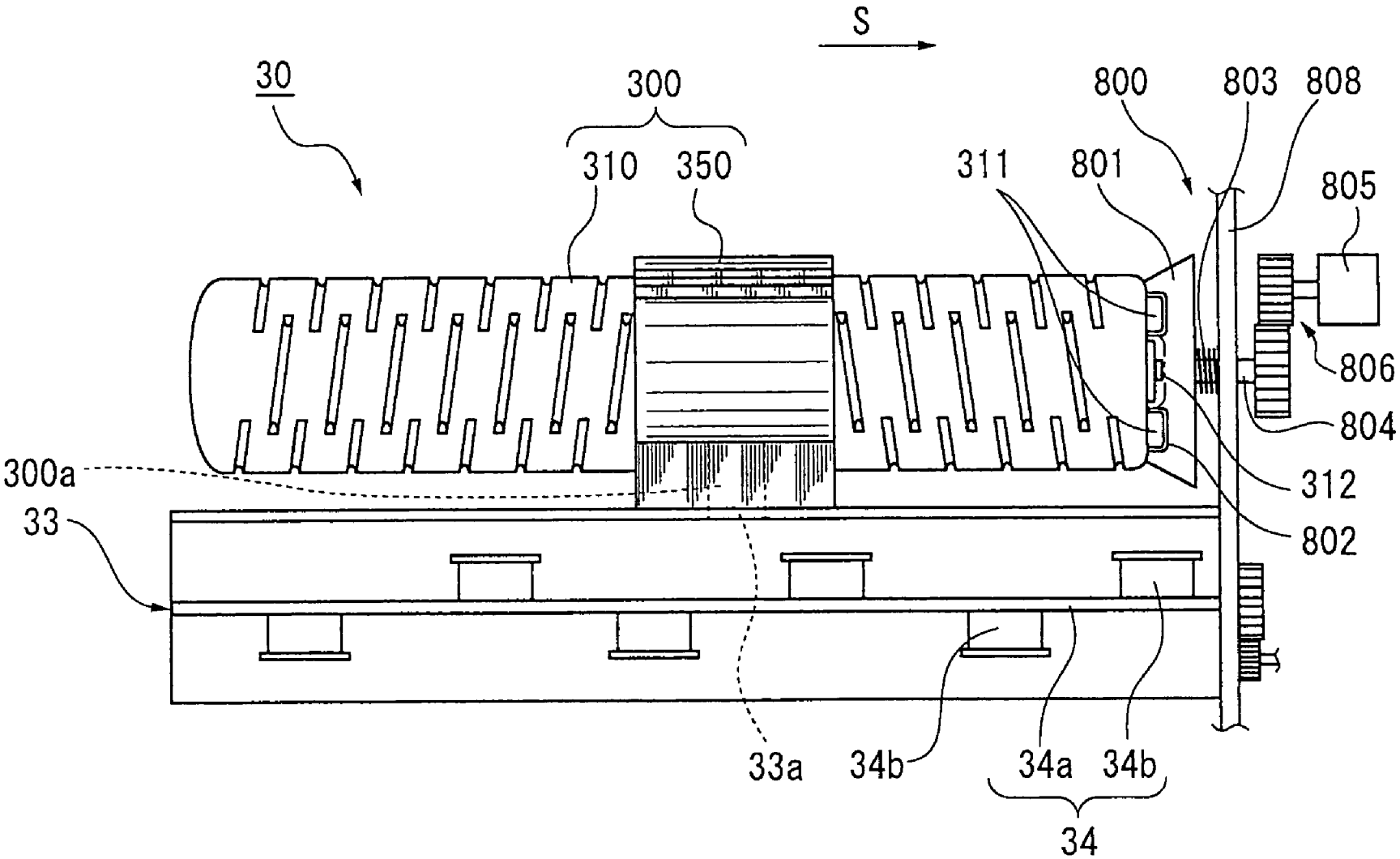
FIG. 6 is an overall front view showing the configuration of the toner feed device in the same example embodiment, when viewed from the P-direction in FIG. 5.

Next, the configuration of the developing unit and toner feed device provided for the image forming apparatus according to the present example embodiment will be described with reference to the drawings. FIG. 5 is an overall sectional side view showing a developing unit and toner feed device provided for the image forming apparatus according to the present example embodiment. FIG. 6 is an overall front view showing the toner feed device in the present example embodiment, viewed in the P-direction in FIG. 5.

As shown in FIG. 5, the exterior of developing unit 2 is formed by a hopper 200, which has a toner input port 201 for receiving toner at a position where the developing unit abuts an opening 30*a* of toner feed device 30 for supplying toner. Arranged inside hopper 200 are a developing roller 202, a paddle roller 203, a mixing roller 204, a conveying roller 205, a partitioning plate 206 and a doctor 207 as a regulating member.

In hopper 200, the toner that was fed from toner feed device 30 and input through toner input port 201 is conveyed by conveying roller 205 to mixing roller 204, where the toner is mixed with a magnetic carrier to thereby prepare a dual-component developer. This developer as it is being agitated by paddle roller 203 is supplied to developing roller 202 for development of electrostatic latent images and conveyed by the electrostatic latent image supported on photoreceptor drum 3. The developer supplied to developing roller 202 is regulated as to its amount of supply by doctor 207. The extra developer cut off thereby is recirculated by partitioning plate 206 so that it goes away from doctor 207.

Toner feed device 30 is arranged adjacent to developing unit 2, and temporarily reserves the toner discharged from toner container 300 filled with toner, in intermediate hopper 33 and then feeds the toner to developing unit 2. In the present example embodiment, toner container 300 is configured so that container body 310 charged with toner is rotatably supported by a supporting structure 350.

As shown in FIG. 6, one side end of container body 310 of toner container 300 is coupled to a main body-side coupler 800 arranged on the main body of image forming apparatus 1A. Main body-side coupler 800 has an approximately disk-shaped joint socket 801 which is rotated by driving force from a drive source 805 such as a motor etc., of image forming apparatus 1A. This joint socket 801 and container body 310 are coupled to each other. Describing the coupling of these in further detail, a recessed fitting arrangement 802 for receiving fitting projections 311 and a refill port cap 312 arranged on one side end of container body 310 is provided for joint socket 801. As toner container 300 is moved so that one end of container body 310 where fitting projections 311 and refill port cap 312 are formed advances toward joint socket 801 (in the S-direction shown in FIG. 6), fitting projections 311 and refill port cap 312 fit into recessed fitting arrangement 802 formed in joint socket 801 when toner container 300 is mounted to image forming apparatus 1A. Thus container body 310 is coupled to joint socket 801. In the state where container body 310 is being coupled to joint socket 801, toner container 300 is set on intermediate hopper 33, and a toner feed aperture 300*a* formed in supporting structure 350 of container body 310 and an opening 33*a* formed in intermediate hopper 33 are positioned so as to establish communication therebetween.

As shown in FIG. 6, joint socket 801 is attached to a rotary shaft 804 so that its center corresponds to the rotational center of rotary shaft 804 that penetrates through a chassis 808 of image forming apparatus 1A. A spring member 803 such as a compression coil spring or the like is attached on rotary shaft 804 between chassis 808 and joint socket 801. Spring member 803 urges joint socket 801 in such a direction as to bring the socket away from chassis 808. Therefore, in order that toner feed device 30 will press joint socket 801, an unillustrated limiting member is provided so that movement of toner feed device 30 in the direction of attachment is limited.

As described above, in toner feed device 30 mounted to image forming apparatus 1A, the driving force from drive source 805 of image forming apparatus 1A is transmitted to joint socket 801 by way of a decelerator 806 such as gears etc. and rotary shaft 804, so as to turn this joint socket 801. As a result, container body 310 rotates about the cylinder axis of container body 310 so as to discharge toner from container body 310 and send it out to intermediate hopper 33 through toner feed aperture 300*a* formed in supporting structure 350.

The toner thus sent out to intermediate hopper 33 is agitated therein by an agitator 34 first. Agitator 34 is composed of an agitator shaft 34*a* and agitating vanes 34*b* attached thereto, as shown in FIG. 6. As agitator shaft 34*a* turns, agitating vanes 34*b* rotate about agitator shaft 34*a* to thereby agitate the toner in intermediate hopper 33 that has been fed from toner container 300. The toner thus agitated by agitator 34 is sent by the agitating action of agitator 34 and conveyed to the feed roller 36 (FIG. 5) side via conveying roller 35 (FIG. 5). Feed roller 36 sends out the toner that has been conveyed from agitator 34 via conveying roller 35 to opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing toner feed aperture 300*a* through which toner from toner container 300 is discharged out of supporting structure 350, as shown in FIG. 5. Specifically, as toner feed aperture 300*a* of supporting structure 350 is released by shutter opening and closing mechanism 400, communication between toner feed aperture 300*a* and opening 33*a* provided for intermediate hopper 33 is established, so that the toner discharged from toner container 300 is supplied to intermediate hopper 33. Here, the configuration and operation of shutter opening and closing mechanism 400 in the present example embodiment will be described later.

Figure 7:
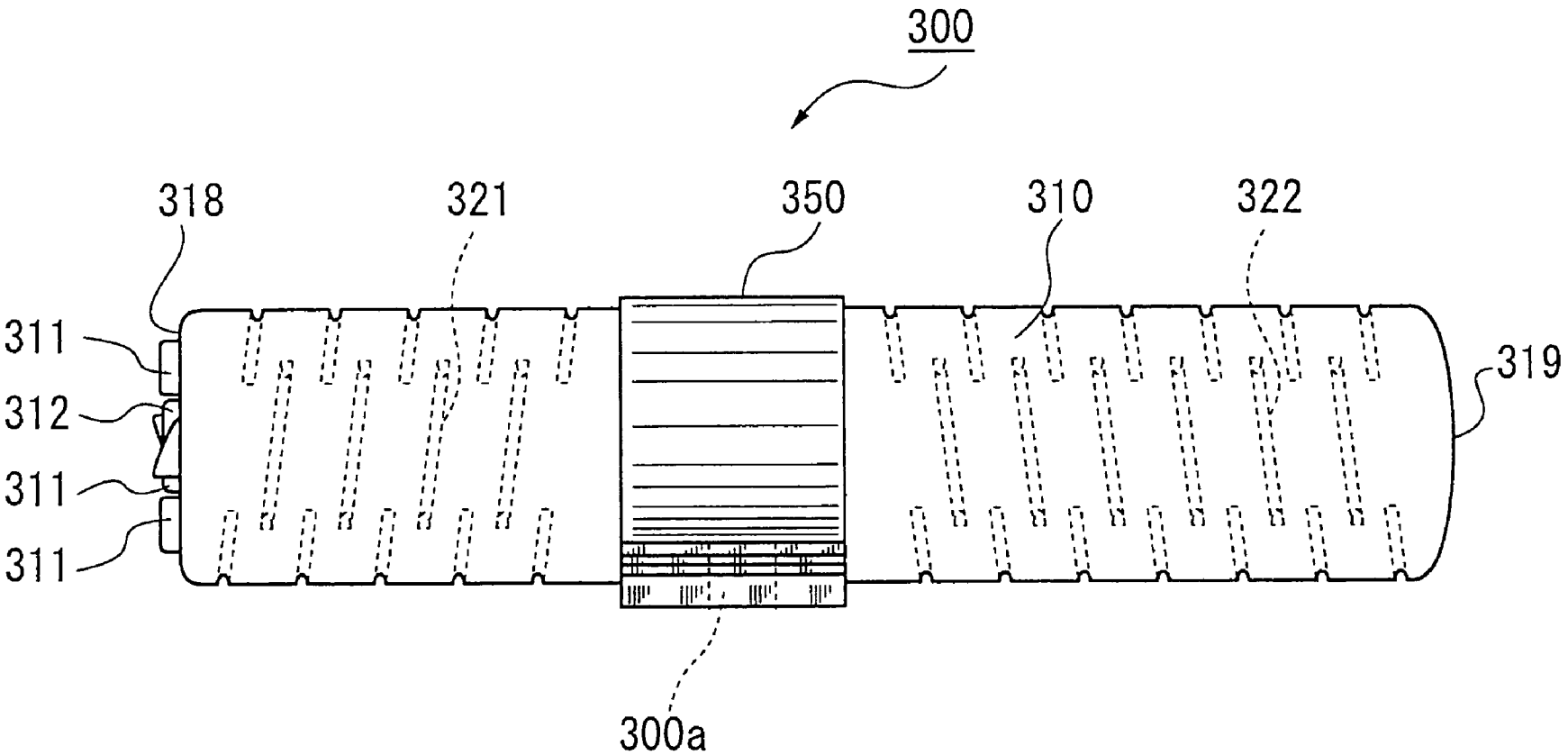
FIG. 7 is a front view showing a toner container in the same example embodiment.
Figure 8:
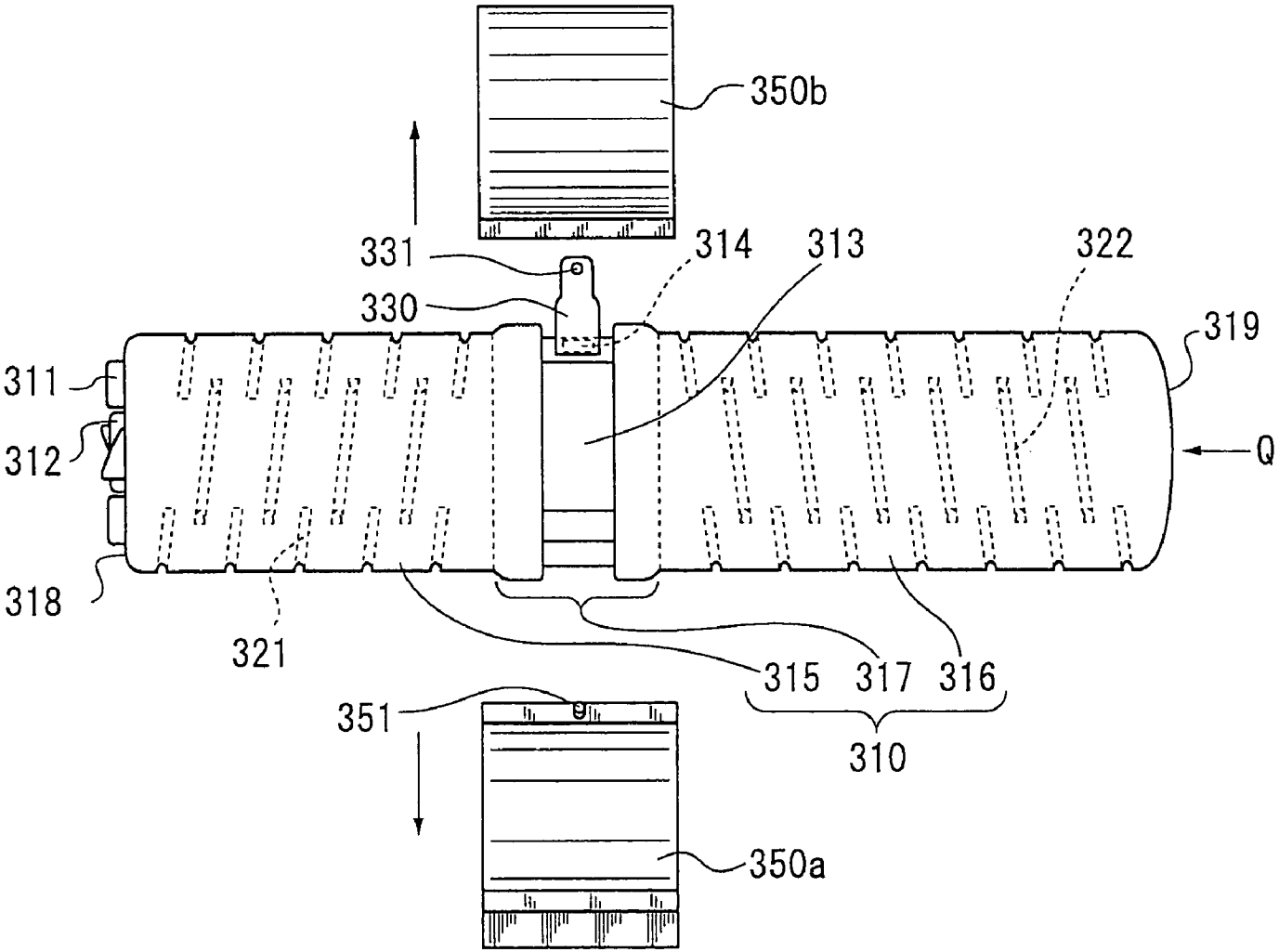
FIG. 8 is a front view showing how the toner container of the same example embodiment is assembled.
Figure 9:
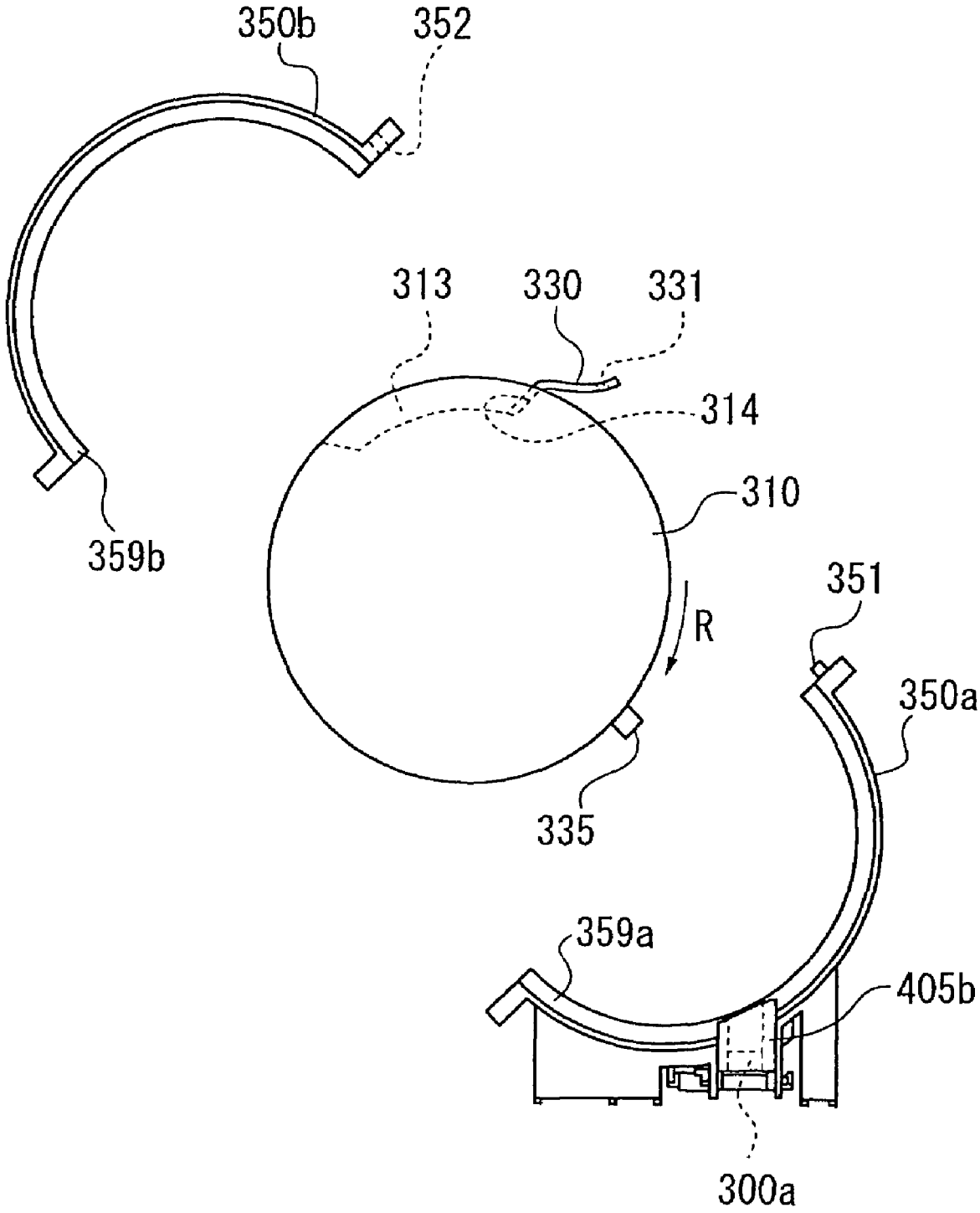
FIG. 9 is a side view, viewed in the Q direction in FIG. 8.
Figure 10:
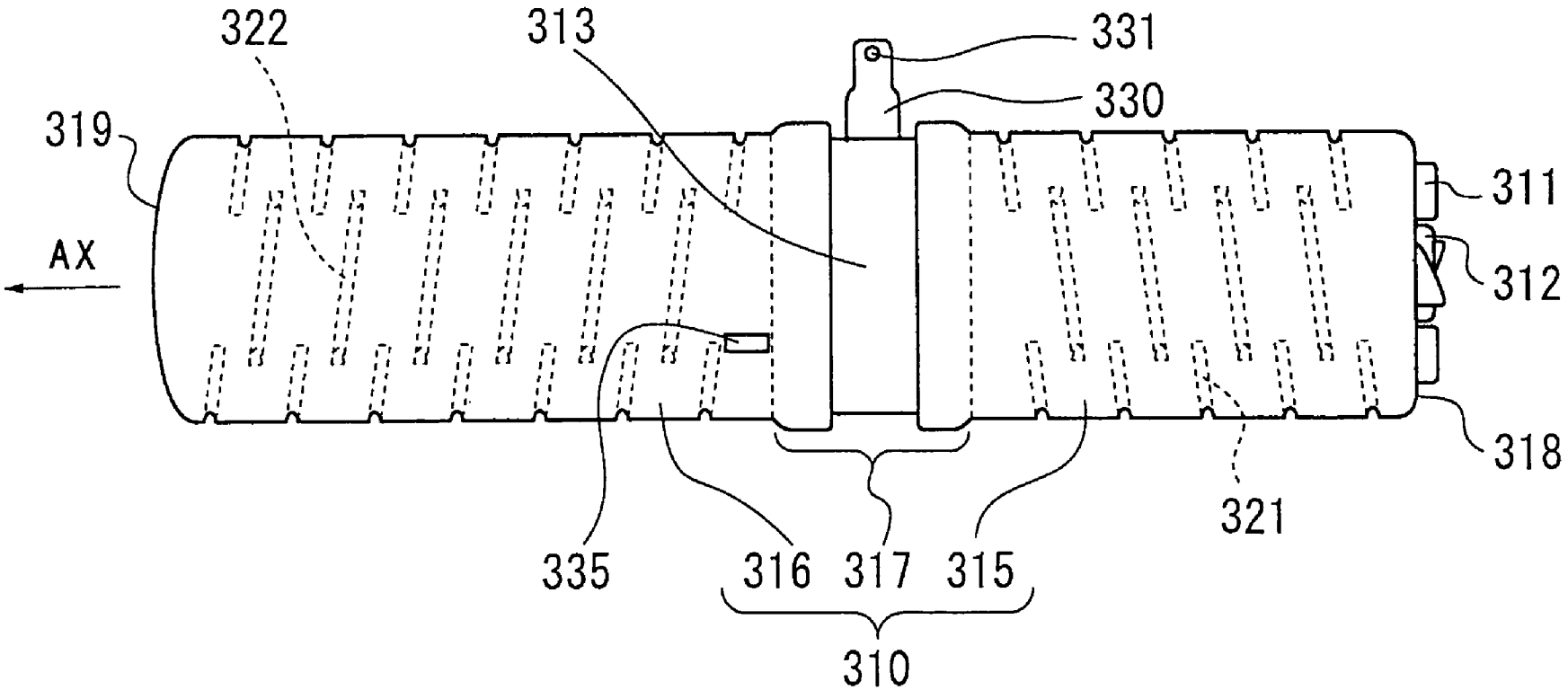
FIG. 10 is a rear side view of the container body shown in FIG. 8.
Figure 11A:
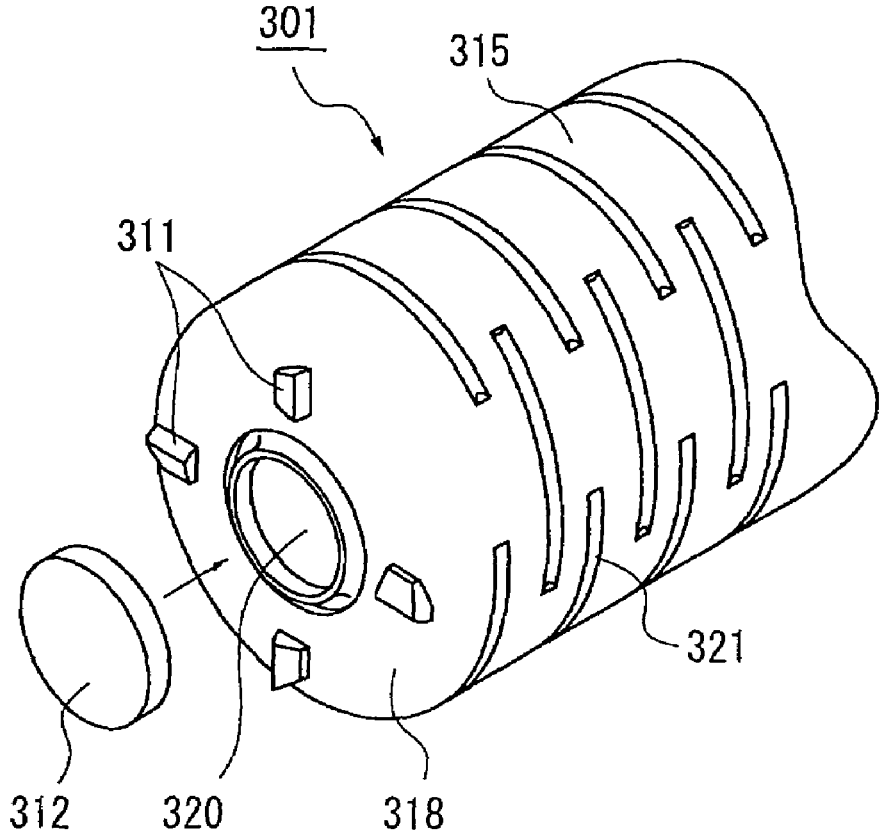
FIG. 11A is a perspective view showing the end part of the container body in the same example embodiment, at the side coupled to the main body-side coupler.
Figure 11B:
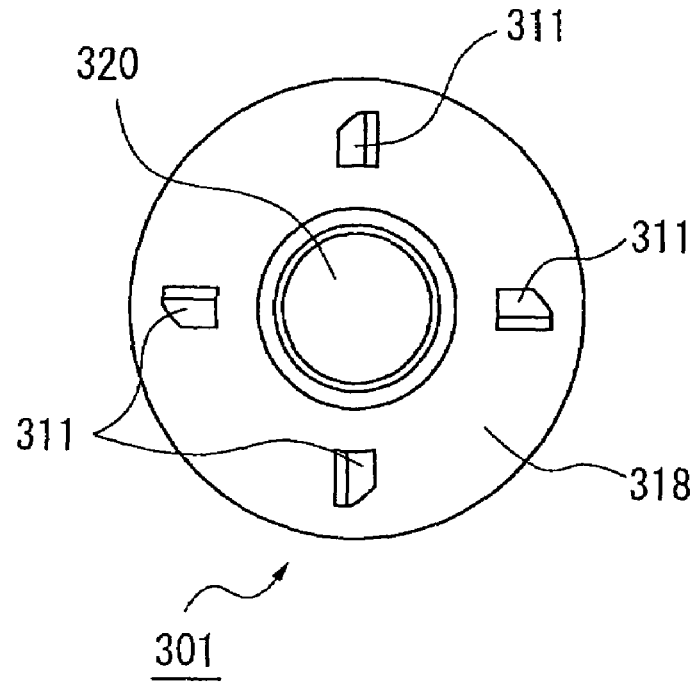
FIG. 11B is a front view of the same end part.
Figure 12:
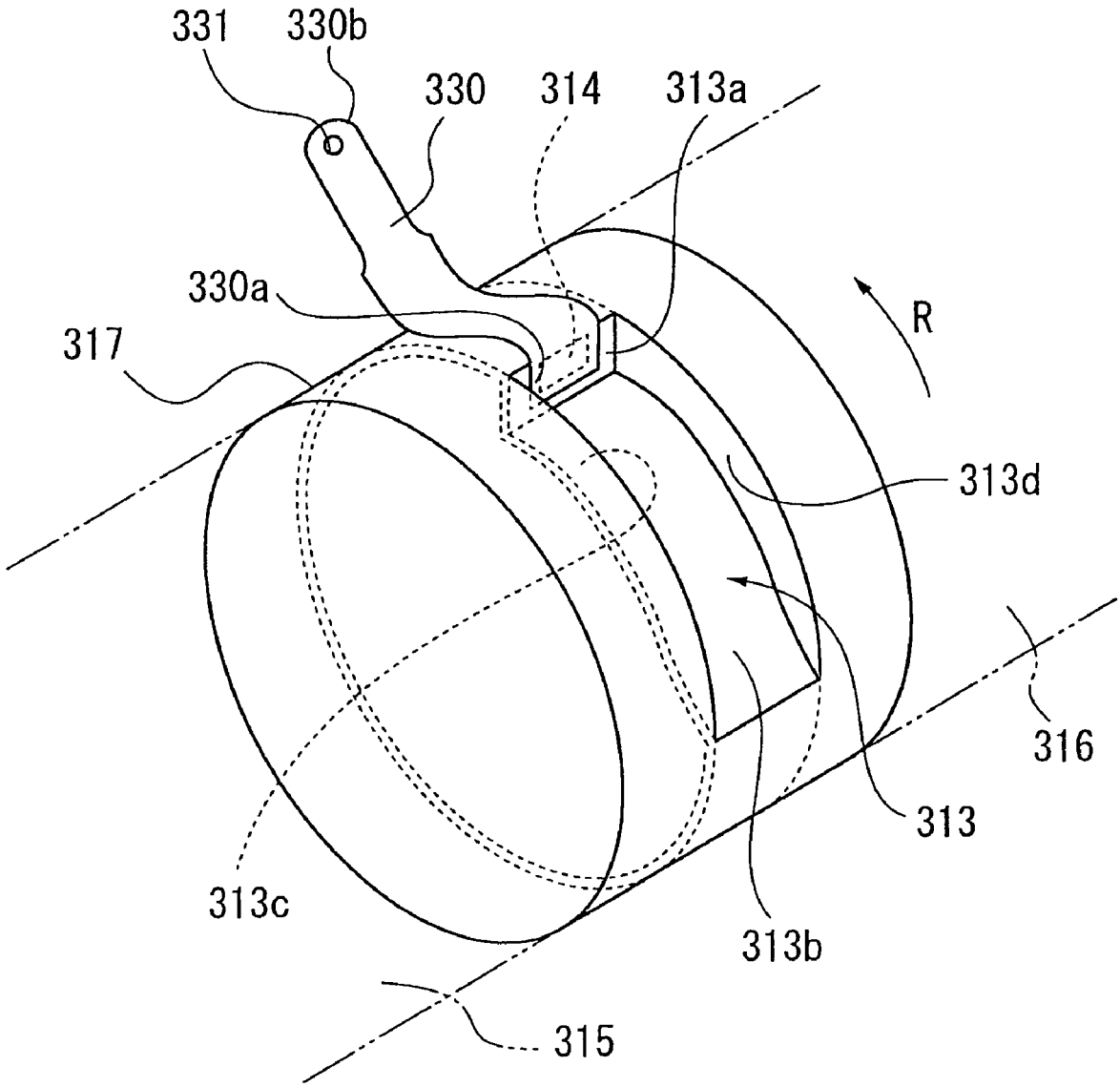
FIG. 12 is a partial perspective view for explaining the configuration around a toner discharge aperture of the container body in the same example embodiment.
Figure 13:
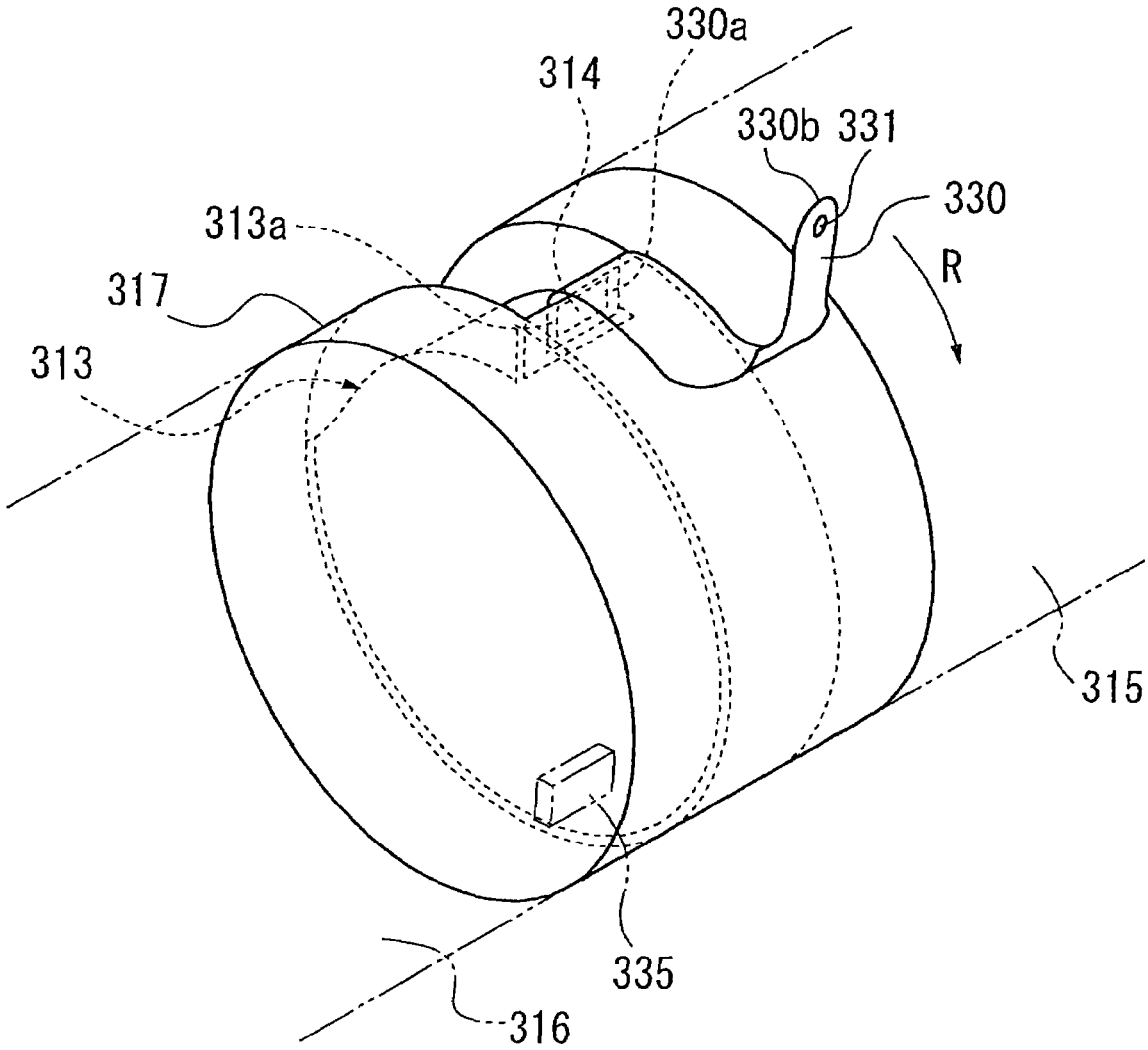
FIG. 13 is a partial perspective view, viewed from the rear side of the container body shown in FIG. 12.
Figure 14A:
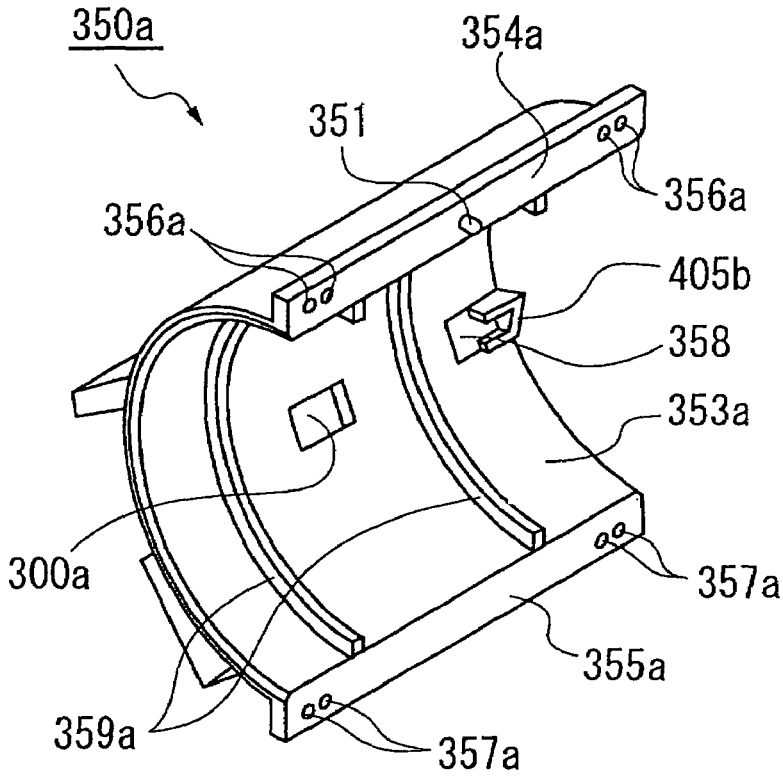
FIG. 14A is a perspective view showing a configuration of a first supporting member of a supporting structure in the same example embodiment.
Figure 14B:
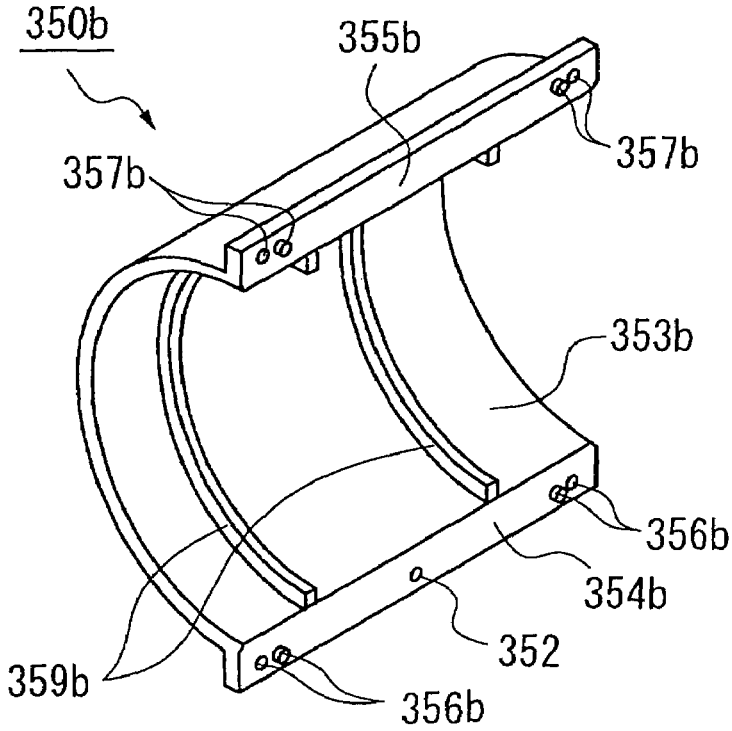
FIG. 14B is a perspective view showing a configuration of a second supporting member of the supporting structure in the same example embodiment.

Next, the configuration of the toner container in the present example embodiment will be described with reference to the drawings. FIG. 7 is a front view showing a toner container in the present example embodiment; FIG. 8 is a front view showing how the toner container of the present example embodiment is assembled; and FIG. 9 is a side view, viewed in the Q-direction in FIG. 8. Here, FIGS. 7 and 8 are front views, viewed in the direction opposite to the P-direction in FIG. 5. FIG. 10 is a rear side view of the container body shown in FIG. 8. FIG. 11A is a perspective view showing the end part of the container body of the present example embodiment, at the side coupled to the main body-side coupler; FIG. 11B is a front view of the same end part; FIG. 12 is a partial perspective view, viewed from the front side, for explaining the configuration around the toner discharge aperture of the container body in the present example embodiment, FIG. 13 is a partial perspective view, viewed from the rear side of the container body shown in FIG. 12; FIG. 14A is a perspective view showing a configuration of a first supporting member of a supporting structure in the present example embodiment; and FIG. 14B is a perspective view showing a configuration of a second supporting member of the supporting structure in the present example embodiment.

As described already, toner container 300 (FIG. 7) has a configuration including approximately cylindrical container body 310 and supporting structure 350. As shown in FIGS. 8 and 9, container body 310 is rotatably supported by supporting structure 350 assembled of approximately semi-cylindrical first and second supporting members 350*a* and 350*b*.

Container body 310 is composed of, as shown in FIG. 10, three approximately cylindrical parts, namely, first container part 315, second container part 316 and third container part 317. Each of these container parts is integrally formed by blow molding of a synthetic resin such as polyphenylene ether, polyethylene or the like, for example. The aforementioned third container part 317 is disposed between first and second container parts 315 and 316. The first and second container parts 315 and 316 have bottom portions 318 and 319, respectively, which constitute the bottoms of cylindrical container body 310. The thus constructed container body 310 has a toner storing portion for storing toner therein. Formed on the outer peripheral surface at the approximate center of third container part 317 of container body 310 is a toner feed recess 313, depressed radially inwards. At one end of this toner feed recess 313 there is a toner discharge aperture 314 (FIG. 8) for discharging toner from toner container 310, as will be described below. Container body 310 is rotated about the cylinder axis AX of the length of container body 310 as third container part 317 of the thus constructed container body 310 is being supported by supporting structure 350, so that toner is discharged from toner discharge aperture 314 to toner feed recess 313 which is formed on the outer peripheral surface of toner container 310. Here, the Q-direction in FIG. 8 is the same as the direction in which cylinder axis AX extends.

First container part 315 (FIGS. 8 and 10) is arranged on the side where the aforementioned main body-side coupler 800 (see FIG. 6) of the image forming apparatus is located. Accordingly, bottom portion 318 of first container part 315 is formed with four fitting projections 311 that project from bottom 318 as a coupler to be coupled with main body-side coupler 800, as shown in FIGS. 11A and 11B. These fitting projections 311 are arranged so that opposing fitting projections are positions essentially point symmetrically about the center of bottom portion 318 or the cylinder axis AX of approximately cylindrical container body 310. Toner feed device 30 is attached to main body-side coupler 800 of image forming apparatus 1A by means of these fitting projections 311, and container body 310 receives driving force from a drive source from image forming apparatus 1A and rotates about cylinder axis AX.

Further, bottom portion 318 has an opening penetrating therethrough as a toner supply port 320, to which refill port cap 312 is removably fitted. Toner refill port 320 is provided to refill container body 310 of toner container 300 with toner and is formed in the center of bottom portion 318 in a circular shape centered at the aforementioned cylinder axis. Refill port cap 312 totally covers toner refill port 320 and seals it. This refill port cap 312 is fitted to toner refill port 320 in such a manner that it will not come off due to rotation of container body 310 about the cylinder axis. Further, refill port cap 312 is adapted to be detached from toner refill port 320 when toner is loaded from toner refill port 320 into container body 310.

Formed on the inner surface of the peripheral side of the aforementioned first container part 315 (to be referred to as inner peripheral surface) are a plurality of conveyor elements 321 in order to convey the toner inside container body 310 of toner container 300 along the direction of the cylinder axis. These conveyor elements 321 are formed projectively from the inner peripheral surface toward the cylinder axis AX (radially inwards of container body 310), at regular intervals with respect to the peripheral direction and the cylinder axis direction of first container part 315. Conveyor elements 321 are arranged parallel to each other in the cylinder axis direction.

The aforementioned conveyor elements 321 are formed being inclined at a predetermined angle with the direction of a line that lies on the inner peripheral surface and is perpendicular to the cylinder axis AX of container body 310, in order to convey toner from the bottom portion 318 side toward third container part 317 (FIG. 10). In other words, each of these conveyor elements 321 is formed so that its downstream end is located closer to third container part 317 having toner discharge aperture 314 (FIG. 8) than its upstream end, with respect to the direction of rotation of container body 310 about the cylinder axis.

Second container part 316 is formed with bottom portion 319 of container body 310 and arranged in approximately cylindrical container body 310 at the end that is opposite to the side where main body-side coupler 800 (see FIG. 6) provided for image forming apparatus 1A is laid out, as shown in FIG. 10. The inside diameter of second container part 316 is formed so as to be equal to that of first container part 315.

Formed on the inner peripheral surface of second container part 316 are a plurality of conveyor elements 322 in order to convey the toner inside container body 310 along the direction of the cylinder axis AX. These conveyor elements 322 are formed projectively from the inner peripheral surface toward the cylinder axis, at regular intervals with respect to the peripheral direction and the direction of cylinder axis AX of second container part 316. Conveyor elements 322 are arranged parallel to each other.

The aforementioned conveyor elements 322 are formed being inclined at a predetermined angle with the direction of a line that lies on the inner peripheral surface and is perpendicular to the cylinder axis AX of container body 310, in order to convey toner from the bottom portion 319 side toward third container part 317. In other words, each of these conveyor elements 322 is formed so that its downstream end is located closer to third container part 317 having toner discharge aperture 314 than its upstream end, with respect to the direction of rotation of container body 310 about the cylinder axis.

Further, as shown in FIGS. 10 and 13, a container body-side engaging projection 335 that will engage shutter opening and closing mechanism 400 (FIG. 5) provided for supporting structure 350 (FIG. 5) is formed on the outer peripheral surface of second container part 316 at a position close to third container part 317. Detailed position and other aspects of this container body-side engaging projection 335 will be described later.

As described heretofore, since container body 310 of toner container 300 of the present example embodiment has third container part 317 between first container part 315 and second container part 316, the inclination of conveyor elements 322 formed in second container part 316 is formed opposing that of conveyor elements 321 formed in first container part 315. As a result, as container body 310 rotates about the cylinder axis (in the R-direction in FIG. 9), the toner stored in the first container part 315 and the toner stored in the second container part 316 move towards third container part 317, being guided by conveyor elements 321 and 322 from bottom portions 318 and 319 of container body 310, respectively.

As described above, third container part 317 is the portion that is rotatably supported by supporting structure 350, and its inside diameter is formed marginally greater than that of first and second container parts 315 and 316, as shown in FIGS. 8 and 10. With this configuration, the toner conveyed from the first and second container parts 315 and 316 can be correctly conveyed and brought down into third container part 317, so that it is possible to constantly hold a uniform amount of toner inside third container part 317. Accordingly, even when container body 310 stops rotating, third container part 317 holds a predetermined amount of toner, so that it is possible to give a stable supply of toner immediately after container body 310 is restarted to rotate. Further, since a fixed amount of toner can be held in third container part 317 if the remaining amount of toner in container body 310 has become lower, it is possible to make stable supply of toner over a long period.

As shown in FIG. 12, third container part 317 is formed with a toner feed recess 313 that has a predetermined width with respect to the cylinder axis AX of container body 310 and extends on the outer peripheral surface of container body 310 one round on the outer peripheral surface in the rotational direction of container body 310. This toner feed recess 313 is formed so that it sinks from the outer surface of the peripheral side of third container part 317 (to be mentioned hereinbelow as the outer peripheral surface) toward the cylinder axis AX. The thus configured toner feed recess 313 serves as a space for holding the toner discharged from container body 310 and is also used as a space for delivering toner from toner feed recess 313 to toner feed aperture 300*a* (FIGS. 7 and 9) formed in supporting structure 350. Further, since toner feed recess 313 is formed in a depressed configuration on the outer peripheral surface of third container part 317, it is possible to reduce the contact surface between third container part 317 and supporting structure 350 during rotation of container body 310. As a result, the friction between supporting structure 350 and container body 310 during rotation of container body 310 can be reduced so as to realize smooth rotation of container body 310 of toner container 300.

As shown in FIG. 12, toner feed recess 313 is defined by an end wall portion 313*a*, a bottom wall portion 313*b*, a first side wall portion 313*c* and a second wall portion 313*d*. End wall portion 313*a* is arranged at the downstream end of toner feed recess 313 with respect to the rotational direction R of container body 310 and formed approximately perpendicularly to the outer peripheral surface of third container part 317. Formed in end wall portion 313*a* is a toner discharge aperture 314 as an opening connected to the interior of container body 310 in order to discharge toner from container body 310 to toner feed recess 313.

Bottom wall portion 313*b* is arranged extending in the rotational direction R so that its downstream end with respect to the rotational direction R is connected to end wall portion 313*a* while its upstream end is smoothly connected to the outer peripheral surface of third container part 317. That is, bottom wall portion 313*b* is formed roughly parallel to the outer peripheral surface and closer to cylinder axis AX than the outer peripheral surface of third container part 317 is.

The aforementioned first side wall portion 313*c* and second side wall portion 313*d* are arranged so as to be approximately parallel to each other and vertical to the outer peripheral surface of third container part 317 and bottom wall portion 313*b*, forming both sides of toner feed recess 313, i.e., the both sides with respect to the direction of cylinder axis AX of container body 310. The aforementioned first side wall portion 313*c* and second side wall portion 313*d* are each connected at their downstream ends with respect to the rotational direction R of container body 310 to end wall portion 313*a* while their upstream ends are connected to the outer peripheral surface of third container part 317. Further, first side wall portion 313*c* and second side wall portion 313*d* are each connected to the outer peripheral surface of third container part 317 at their upstream and downstream sides with respect to the rotational direction R.

Further, third container part 317 is formed with an enclosing seal 330 as a sealing element for bonding and sealing toner discharge aperture 314 provided in toner feed recess 313, as shown in FIG. 12. As shown in FIGS. 9 and 12, enclosing seal 330 is formed in an approximate arc shape with a predetermined length in the peripheral direction of container body 310 and arranged along the end face on which toner discharge aperture 314 of container body 310 is formed. One end 330*a* of enclosing seal 330 is bonded to toner discharge aperture 314 so as to seal off the toner discharge aperture 314 of toner feed recess 313. On the other hand, the other end 330*b* of enclosing seal 330 is formed with an engaging hole 331, which is fixed to supporting structure 350 by engagement with a supporting structure-side engaging projection 351 (FIG. 9) formed in supporting structure 350.

With this configuration, when enclosing seal 330 is peeled off by rotation of container body 310 of toner container 300, second end 330*b* of enclosing seal 330 is pulled by supporting structure-side engaging projection 351 of supporting structure 350 as container body 310 rotates in the direction of arrow R, and the first end 330*a* of enclosing seal 330 is peeled off toner discharge aperture 314 so as to open toner discharge aperture 314. In contrast, when container body 310 rotates in the direction opposite the direction of arrow R, the second end 330*b* of enclosing seal 330 is hooked by supporting structure-side engaging projection 351 provided for supporting structure 350 (first supporting member 350*a*) so that enclosing seal 330 pulls container body 310. As a result, the rotation of container body 310 in the opposite direction can be prevented, thus stabilizing container body 310 without its being rattled during toner container 300 is being conveyed or the like.

As to the material of enclosing seal 330, in order to reduce the difference in pressure between the interior and exterior of container body 310, a material having air permeability is preferably used. Also, since it is preferred to prevent adherence of moisture to enclosing seal 330 and the toner inside container body 310, the enclosing seal is preferably formed of a material having hygroscopicity. Further, enclosing seal 330 is preferably formed of a material that is slidable and can be bonded to seal the toner discharge aperture 314 by thermal compression bonding etc. Examples of the martial for enclosing seal 330 meeting the above conditions include; polyethylene terephthalate (PET), polyethylene, polypropylene, felt and the like. In the present example embodiment, the enclosing seal 330 is formed of a sheet of paper made of polyester (PET) or the like, being coated with a felt made of extra fine polyester fiber, specifically, a product of Du Pont Kabushiki Kaisha "Tyvek" (registered trademark).

On the other hand, supporting structure 350 is constructed of, as already described, approximately semi-cylindrical first and second supporting members 350*a* and 350*b*, and this supporting structure 350 rotatably supports third container part 317 located in the approximate center of container body 310.

First supporting member 350*a* has an approximately semi-cylindrical configuration as shown in FIG. 14A and is formed with the aforementioned toner feed aperture 300*a* at the approximate center of its inner side curved surface portion 353*a*. Also formed at the approximately center of inner side curved surface 353*a* of first supporting member 350*a* is a regulating recess 358 into which a regulating member 405*b* (FIG. 16) for limiting the moving range of the closing operation of a shutter element 401 (FIG. 16) of the aftermentioned shutter opening and closing mechanism 400 fits (FIG. 14A shows a state where regulating member 405*b* has fitted therein). This regulating member 405*b* is arranged with its approximately U-shaped part projected from inner peripheral curved surface 353*a* of first supporting member 350*a* and has such a height (the amount of projection from inner peripheral surface 353*a*) as to abut container body 310 when supporting structure 350 supports container body 310. Accordingly, when shutter element 401 of shutter opening and closing mechanism 400 is closing toner feed aperture 300*a*, container body-side engaging projection 335 (FIGS. 9 and 10) formed on the side surface of container body 310 is engaged with regulating member 405*b* (FIG. 15). The operation of container body-side engaging projection 335 becoming engaged with regulating member 405*b* provided for shutter opening and closing mechanism 400 will be described later.

Further, in order to secure the clearance for rotation of container body 310 as well as to secure the stability in supporting container body 310 by supporting structure 350, a pair of rib-like container body engaging portions 359*a* (FIG. 14) are formed on inner curved surface portion 353*a*. These container body engaging portions 359*a* are arranged in parallel to each other and spaced approximately the same distance as the width (the dimension in the direction of cylinder axis AX) of third container part 317. These engaging portions 359*a* are connected to corresponding container body engaging portions 359*b* formed on the aftermentioned second supporting member 350*b* when first supporting member 350*a* and second supporting member 350*b* are assembled to complete supporting structure 350. The thus constructed paired ribs of container body engaging portions 359*a* and 359*b* and inner peripheral curved surfaces 353*a* and 353*b* hold third container part 317 to thereby support container body 310 in a rotatable manner on supporting structure 350.

In addition, both the side edges (the parts that are connected to second supporting member 350*b*) of inner peripheral curved surface portion 353*a* are formed with first and second flanges 354*a* and 355*a*. In each of flanges 354*a* and 355*a*, fitting recesses 356*a* or 357*a* are formed at both longitudinal ends (the sites connected to second supporting member 350*b*) of the flange and are fitted to corresponding fitting projections 356*b* or 357*b* formed at both longitudinal ends of the flange 354*b* or 355*b* of aftermentioned second supporting member 350*b*. Formed at the approximate center of first flange 354*a* is a supporting structure-side engaging projection 351 for engagement with engaging hole 331 formed at the other end 330*b* of enclosing seal 330 (FIG. 8). Further, formed on the outer side of first supporting member 350*a*, at the position where toner feed aperture 300*a* is arranged, is shutter opening and closing mechanism 400 (FIG. 15) for opening and closing toner feed aperture 300*a*. The configuration and operation of shutter opening and closing mechanism 400 will be described later.

Second supporting member 350*b* also has an approximately semi-cylindrical configuration as shown in FIG. 14B. Similarly to first supporting member 350*a*, in order to secure the clearance for rotation of container body 310 as well as to secure the stability in supporting container body 310 by supporting structure 350, a pair of rib-like container body engaging portions 359*b* are formed on inner curved surface portion 353*b*. These container body engaging portions 359*b* are arranged in parallel to each other and spaced approximately the same distance as the width of third container part 317. In addition, both the side edges of inner curved surface portion 353*b* are formed with first and second flanges 354*b* and 355*b*. In each of flanges 354*b* and 355*b*, fitting projections 356*b* or 357*b* are formed at both longitudinal ends of the flange and are fitted correspondingly to the aforementioned fitting recesses 356 or 357*a* formed at both longitudinal ends of the flange 354*a* or 355*a* of the aforementioned first supporting member 350*a*. Formed at the approximate center of first flange 354*b* is an engaging recess 352 that fits supporting structure-side engaging projection 351 formed in first flange 354*a*.

As first supporting member 350*a* and second supporting member 350*b* are thus configured as above, first flange 354*a* of first supporting member 350*a* is joined to first flange 354*b* of second supporting member 350*b*, and second flange 355*a* of first supporting member 350*a* is joined to second flange 355*b* of second supporting member 350*b*, to thereby complete the approximately cylindrical supporting structure 350 which supports container body 310 in a rotatable manner over the whole circumference.

Figure 15A:
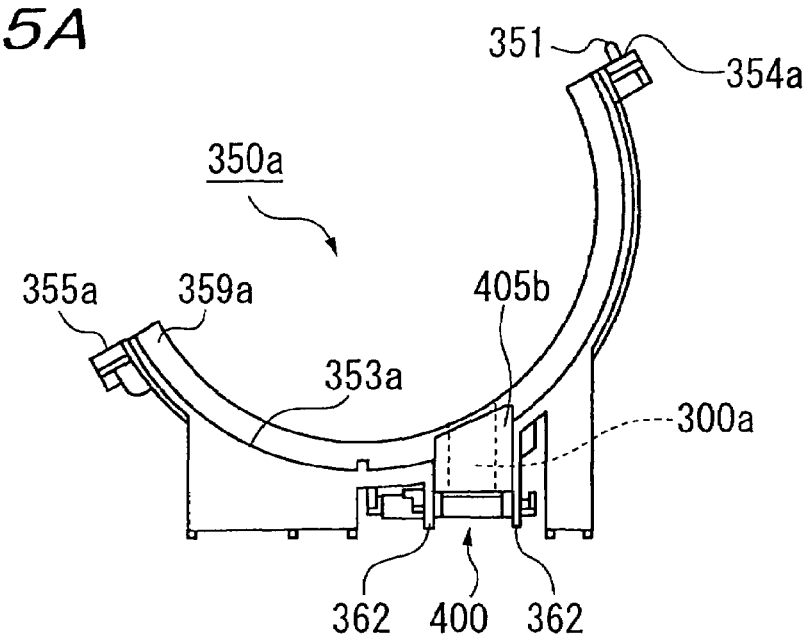
FIG. 15A is a side view showing the first supporting member of the supporting structure of the toner container in the same example embodiment.
Figure 15B:
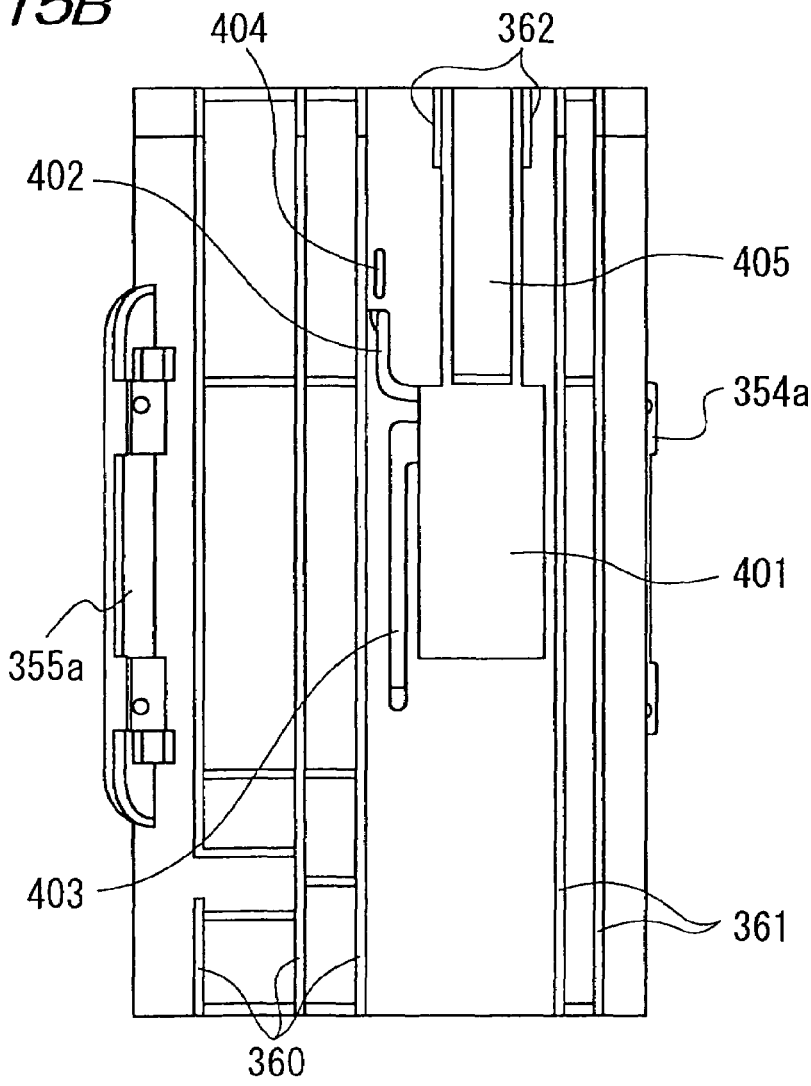
FIG. 15B is a plan view showing the first supporting member, viewed from its bottom side.
Figure 16A:
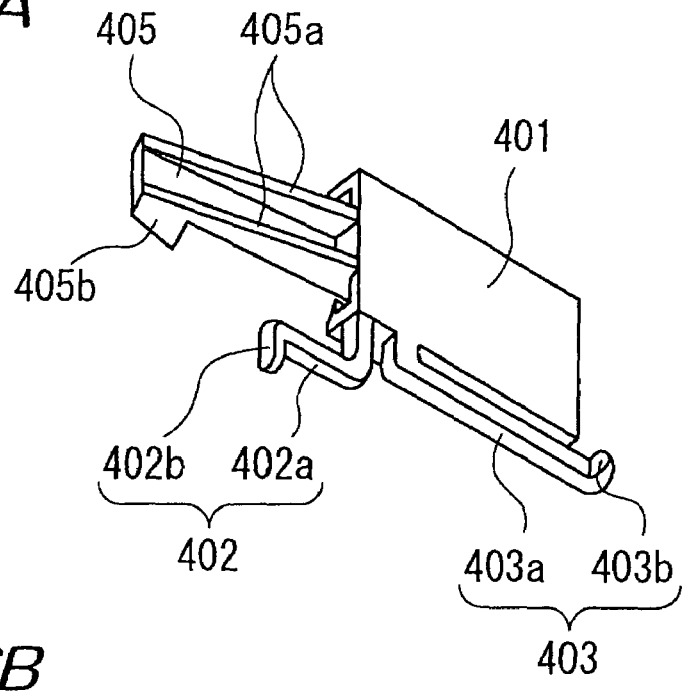
FIG. 16A is a perspective view showing a shutter element provided for a shutter mechanism in the same example embodiment, viewed from its front.
Figure 16B:
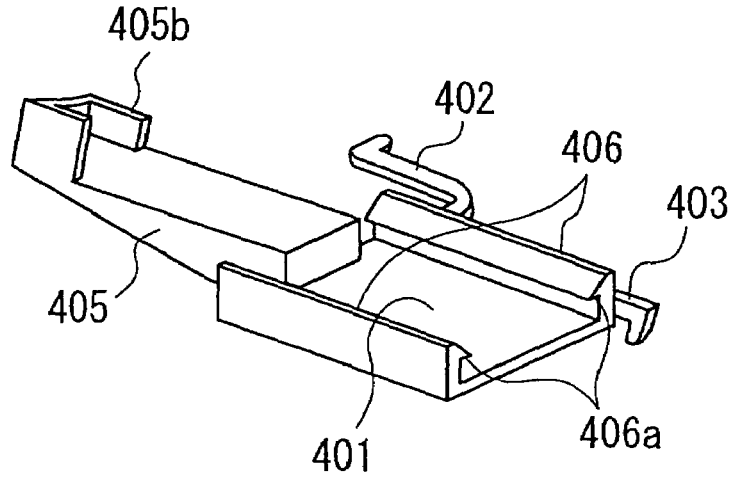
FIG. 16B is a perspective view showing the same shutter element, viewed from its rear.
Figure 16C:
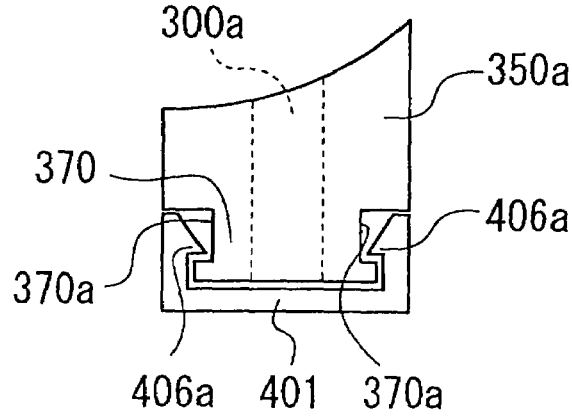
FIG. 16C is an illustrative view showing a state in which the shutter element is attached to the first supporting member.

Next, the shutter opening and closing mechanism provided for the first supporting member in the supporting structure of the toner container of the present example embodiment will be described with reference to the drawings. FIG. 15A is a side view showing first supporting member 350*a* of supporting structure 350 of the toner container in the present example embodiment; FIG. 15B is a plan view showing first supporting member 350*a*, viewed from its bottom side; FIG. 16A is a perspective view showing shutter element 401 provided for the shutter opening and closing mechanism in the present example embodiment, viewed from its front; FIG. 16B is a perspective view showing the same shutter element 401, viewed from its rear; and FIG. 16C is an illustrative view showing the way in which the shutter element 401 is attached to first supporting member 350*a*.

As described above, first supporting member 350*a* (FIG. 15) is formed in a semi-cylindrical shape and has toner feed aperture 300*a* formed at the approximate center (FIG. 14A) of inner curved surface portion 353*a*. Formed along both side edges of inner curved surface portion 353*a* are first and second flanges 354*a* and 355*a*.

As shown in FIGS. 15A and 15B, on the bottom side of first supporting member 350*a*, a plate-formed, first fixing member 360 (FIG. 15B) and second fixing member 361 (FIG. 15B) for attachment and fixture of toner container 300 to intermediate hopper 33 (FIG. 5) of toner feed device 30 are formed parallel to each other and erected outside from inner curved surface portion 353*a*. Specifically, first fixing member 360 and second fixing member 361 provide the function of a supporting base for the placement face of first supporting member 350*a* so as to hold container body 310 (FIG. 5) supported by supporting structure 350 approximately horizontal. Further, on the downstream side of toner feed aperture 300*a* located between first fixing member 360 and second fixing member 361, a shutter opening and closing mechanism 400 for making control of discharge of the toner supplied from container body 310 to the outside by switching the state of the shutter over the opening on the downstream side of toner feed aperture 300*a* (FIG. 15A) between the open and closed states is arranged. Accordingly, first fixing member 360 and second fixing member 361 are adjusted as to their height so as to establish the clearance between supporting structure 350 and intermediate hopper 33 of toner feed device 30 so that shutter opening and closing mechanism 400 will function correctly.

As shown in FIG. 15B, shutter opening and closing mechanism 400 is comprised of shutter element 401 for opening and closing toner feed aperture 300*a*, first and second regulating members 402 and 403 formed at the side of shutter element 401 and an anti-slide rib 404 formed on the bottom of first supporting structure 350*a*, standing erect with respect to the sliding surface of shutter element 401.

Shutter element 401 is an approximately rectangular plate-like member formed of a synthetic resin or the like having a certain degree of elasticity and hardness, such as POM (polyoxymethylene) or the like, and has a guide portion 405 that is extended from one end on the side from which shutter element 401 starts to open (to be referred to hereinbelow as the front end side) so as to guide the opening and closing action of shutter element 401 along the fixed direction. Guide portion 405 is integrally formed with shutter element 401, and has erected pieces 405*a* standing upright along both side edges thereof. These erected pieces are formed inclined, reducing their height from their proximal side connected to shutter element 401 toward the distal side, as shown in FIG. 16A. On the front end side of guide portion 405, approximately U-shaped regulating member 405*b* that limits the movable range of the closing action of shutter 401 is formed erected on the opposing side of erected pieces 405*a* of guide portion 405. As described already, this regulating member is fitted into regulating recess 358 (FIG. 14A) formed at the approximate center near the side end of inner curved surface 353*a* of first supporting member 350*a*, so as to limit the movable range of the closing action of shutter element 401. Further, regulating member 405*b* is engaged with container body-side engaging projection 335 (FIGS. 9 and 10) when shutter element 401 of shutter opening and closing mechanism 400 shuts up toner feed aperture 300*a*.

First regulating member 402 is to limit the movement of shutter element 401 before mounting toner container 300 to intermediate hopper 33. As shown in FIGS. 16A and 16B, this regulating member is composed of an approximately L-shaped main piece 402*a*, whose one end is connected to the side part of shutter element 401 and the other end being extended to the front end side, and a hook 402*b* that is formed at the front end side of this main piece 402*a* and projected outside (to the left in FIG. 15). This hook 402*b* abuts anti-slide rib 404 (FIG. 15B) so as to serve as an anti-sliding means for preventing shutter element 401 of shutter opening and closing mechanism 400 from being opened when toner container 300 has not been mounted to intermediate hopper 33. In other words, combination of first regulating member 402 and anti-slide rib 404 constitute the anti-sliding means for preventing shutter element 401 from sliding before toner container 300 is mounted to intermediate hopper 33. First regulating member 402 is formed of a material having a certain degree of elasticity and hardness such as POM (polyoxymethylene) or the like so as to deflect in the width direction of shutter element 402. The details of how first regulating element 402 and anti-slide rib 404 operate to prevent shutter element 401 from sliding will be described later.

The second regulating member 403 is provided to limit the movement of shutter element 401. This is particularly used when shutter element 401 that has been opened is closed. This second regulating member 403 is composed of, as shown in FIG. 16A, an approximately L-shaped main piece 403*a*, whose one end is connected to the side part of shutter element 401 and the other end being extended in the direction opposite to first regulating member 402, and a hook 403*b* that is formed at the opposite end from the connected side of this main piece 403*a* to shutter element 401 and is projected in the direction (upwards in FIG. 16A) opposite to toner feed aperture 300*a*. Similarly to first regulating member 402, second regulating member 403 is also preferably formed of a material having a certain degree of elasticity and hardness such as POM (polyoxymethylene) or the like. The details of how second regulating element 403 operates to limit the movement of shutter element 401 will be described later.

On the other hand, formed on the underside of shutter element 401 are a pair of slide supporting elements 406 which support the shutter element to a shutter guide portion 370 (FIG. 16C) having the aforementioned toner feed aperture 300*a* of supporting structure 350 formed therein and are extended in the longitudinal direction of shutter element 401, as shown in FIG. 16B. That is, as shown in FIG. 16C, slide supporting elements 406 each have a hooking portion 406*a* formed so as to project inwards (toward the opposing side) from the both side edges of shutter element 401, whereby the shutter element can be supported in a slidable manner along, and by, slide recessed portion 370*a* formed in shutter guide portion 370.

Further, on the bottom side of first supporting member 350*a*, in other words, on the side where shutter opening and closing mechanism 400 is disposed in first supporting member 350*a*, a pair of erected portions 362 (FIGS. 15A and 15B) that are erected to the bottom surface are provided between the outer portion of first supporting member 350*a*, and first regulating member 402 and anti-slide rib 404, in order to prevent hands, fingers etc. from touching first regulating member 402 from the outside when toner container 300 has been set on intermediate hopper 33. In the present example embodiment, these erected portions 362 are disposed in the end part on the bottom side of first supporting member 350*a* so that they abut the front end of guide portion 405.

Figure 17:
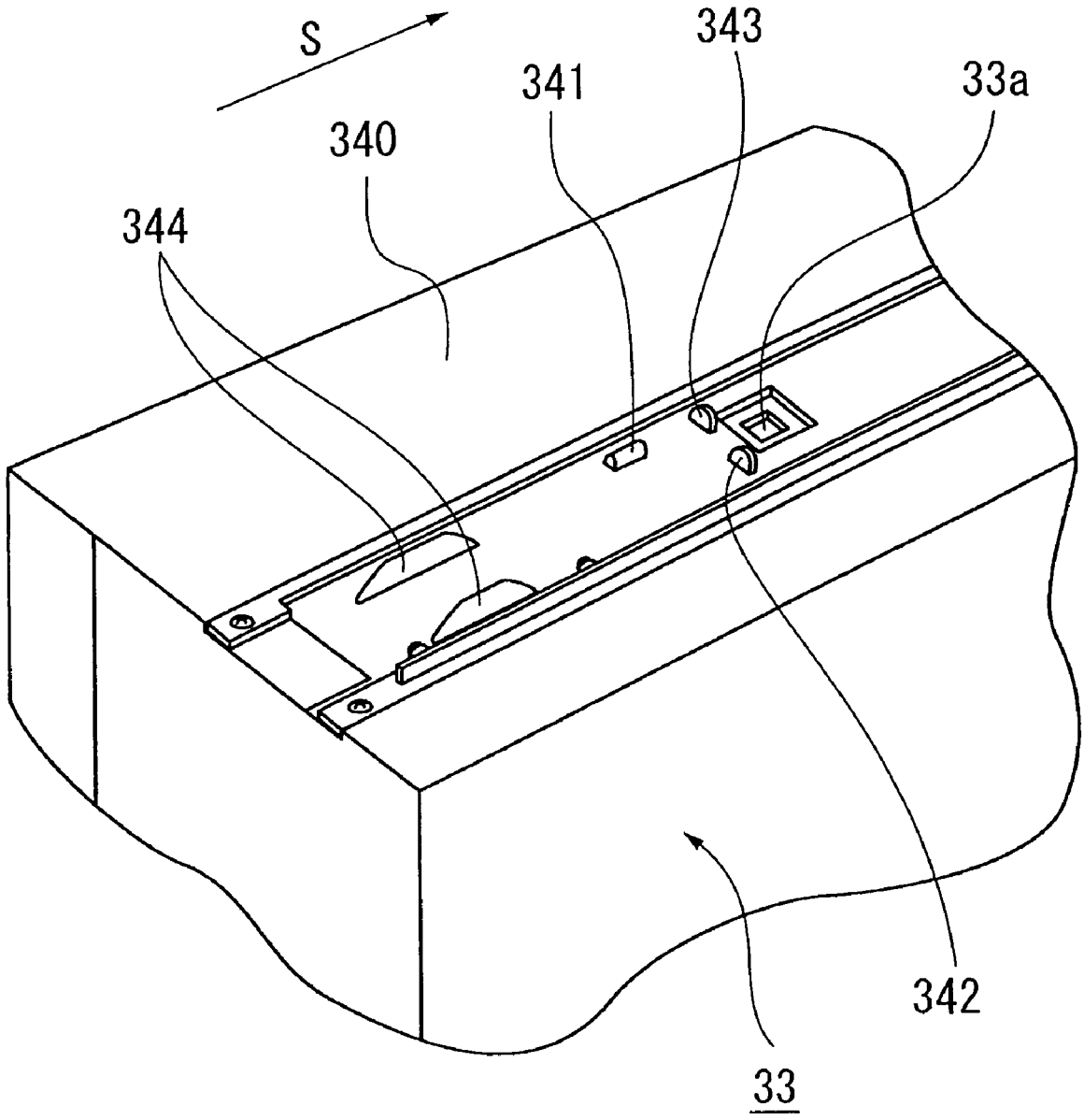
FIG. 17 is a partial perspective view showing essential parts in the mount surface of an intermediate hopper on which the toner container is placed in the same example embodiment.

Next, the configuration of the mount surface on which toner container 300 of the present example embodiment is set to intermediate hopper 33 (FIG. 5) will be described with reference to the drawings. FIG. 17 is a partial perspective view showing essential parts in the mount surface of the intermediate hopper on which the toner container of the present example embodiment is mounted. In FIG. 17, of the toner container mount surface in the intermediate hopper, the part located on the side opposite to the main body-side coupler 800 (FIG. 6) is shown. In this figure, arrow S represents the direction in which toner container 300 is moved so as to be mounted to main body-side coupler 800, and the starting point side of arrow S is expressed as the upstream side.

In the present example embodiment, the toner container mount surface 340 of intermediate hopper 33 to which supporting member 350*a* is mounted, has opening 33*a* that will communicate with toner feed aperture 300*a* when shutter opening and closing mechanism 400 is released, at the position corresponding to toner feed aperture 300*a* (FIG. 14A) provided for supporting structure 350, as shown in FIG. 17. That is, opening 33*a* is formed at such a position as to receive the toner discharged from toner feed aperture 300*a* when toner feed aperture 300*a* of supporting member 350*a* is released by shutter opening and closing mechanism 400 after toner container 300 (FIG. 7) has been mounted to toner container mount surface 340.

Arranged on the upstream side of opening 33*a* in toner container mount surface 340 is a shutter block 341 for releasing the anti-slide function for limiting the movement of shutter element 401 of shutter opening and closing mechanism 400 for closing toner feed aperture 300*a* of supporting structure 350 when toner container 300 has been mounted to intermediate hopper 33. This shutter block 341 is an approximately triangular prism-shaped projected member having an inclined surface 341*a* (FIG. 18B) and is arranged with its length approximately parallel to the S-direction. The distance from the downstream end of shutter block 341 to opening 33*a* is designed to be approximately equal to the distance from the downstream end of shutter element 401 (FIG. 16A) to hook 402*b* (FIG. 16A) of first regulating member 402. Since shutter block 341 is laid out on the upstream side of opening 33*a* of mount surface 340 in the above way, shutter block 341 abuts hook 402*b* when toner container 300 is set to intermediate hopper 33. As a result, main piece 402*a* of first regulating member 402 bends inwards so that hook 402*b* becomes deviated from anti-slide rib 404 (FIG. 15B), hence the constraint on the movement of shutter element 401 by anti-slide rib 404 is released.

Further, a first engaging projection 342 is provided at a position opposing an aftermentioned second engaging projection 343, which is arranged on the downstream side of shutter block 341 on toner container mount surface 340 and near opening 33*a*. This first engaging projection 342 is disposed at such a position as to abut shutter element 401 (FIG. 16) when toner container 300 is mounted on intermediate hopper 33 and slid in the S-direction. Accordingly, when toner container 300 is set on intermediate hopper 33 and slid in the S-direction after the anti-slide function for limiting the movement of shutter element 401 is released, first engaging projection 342 abuts the downstream end of shutter element 401, to thereby open shutter element 401 with the movement of toner container 300 in the S-direction.

Further, arranged on the downstream side of shutter block 341 of toner container mount surface 340 and near opening 33*a* is second engaging projection 343 opposing first engaging projection 342 as mentioned above. This second engaging projection 343 is hooked by hook 403*b* of second regulating member 403 (FIGS. 16A and 16B) of shutter opening and closing mechanism 400 when toner container 300 is dismounted from intermediate hopper 33 of toner feed device 30, so that shutter element 401 shuts up toner feed aperture 300*a*. That is, shutter element 401 is moved in linkage with the dismounting action of toner container 300 from intermediate hopper 33, to thereby close toner feed aperture 300*a* of toner container 300.

Also, a pair of supporting pieces 344 for supporting the rear end part (the rear end on the bottom surface 319 side (FIG. 7) of second container part 316) of container body 310 when toner container 300 is being mounted is formed in toner container mount surface 340 on the upstream side of shutter block 341 of opening 33*a*. These supporting pieces 344 are to create a predetermined clearance between container body 310 of toner container 300 and toner container mount surface 340 and contributes to smooth rotation of container body 310. The shape and configuration of these supporting pieces 344 are not particularly limited. That is, these supporting pieces may be formed in any shape with any material as long as it enables container main body 310 of toner container to rotate smoothly.

Figure 18A:
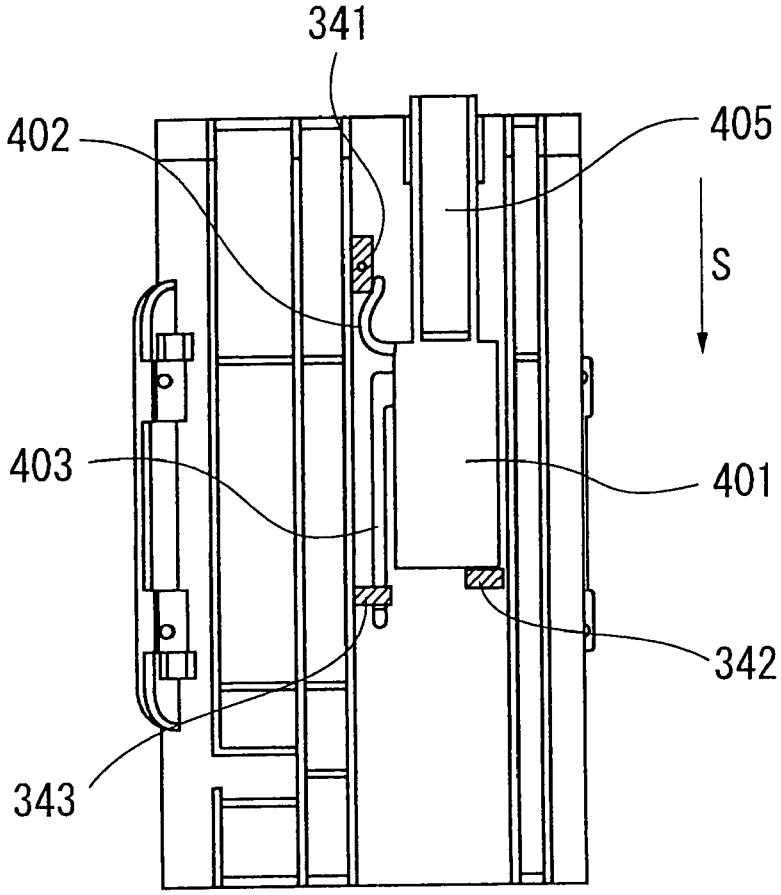
FIG. 18A is a plan view showing the first supporting member, viewed from the bottom side when the toner container of the same example embodiment is set on the intermediate hopper and starts to be slid in the S-direction after the anti-slide function is released.
Figure 18B:
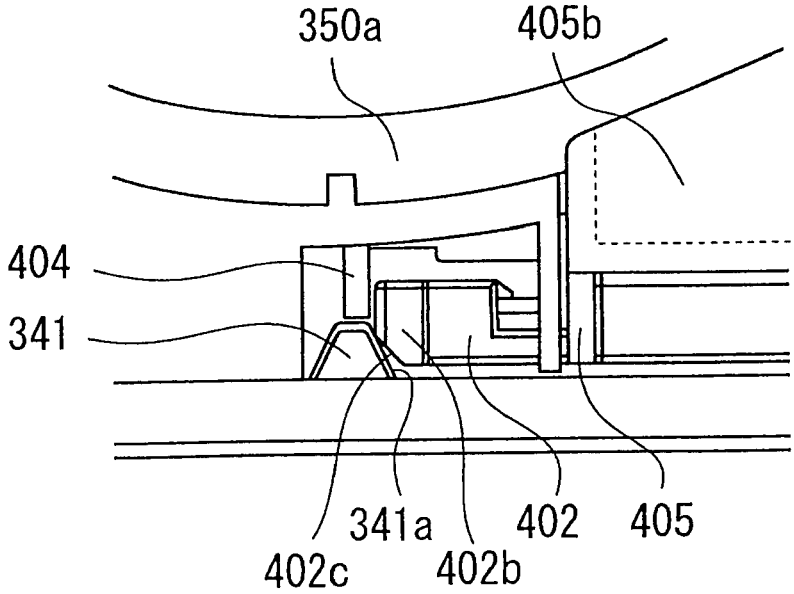
FIG. 18B is a side view showing the vicinity of a hook of the first supporting member when the toner container of the same example embodiment is set on the intermediate hopper and is being slid in the S-direction after the anti-slide function is released.
Figure 19A:
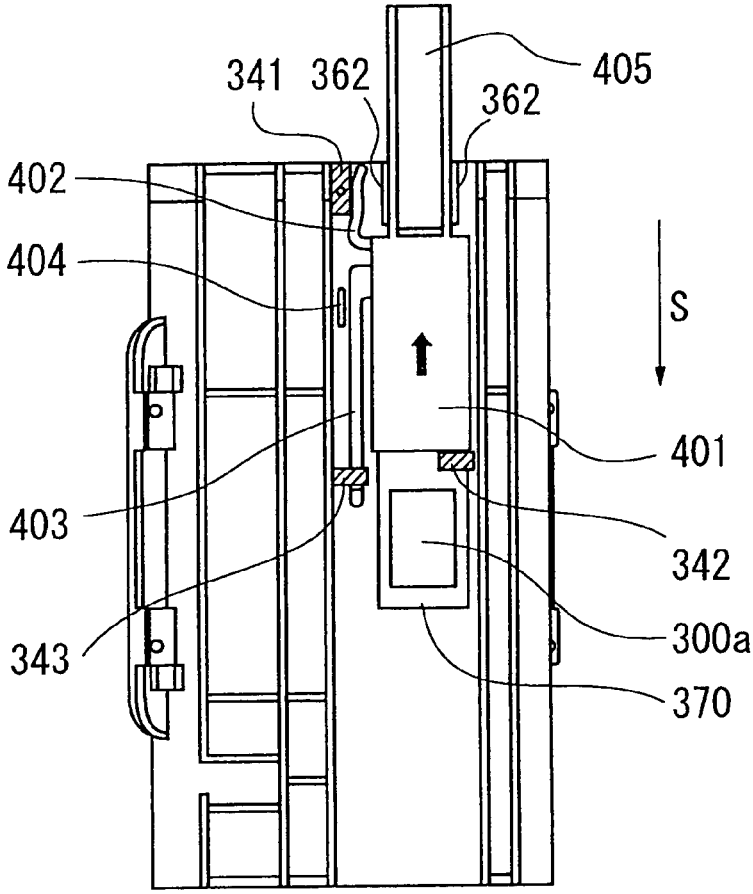
FIG. 19A is a plan view showing the first supporting member, viewed from the bottom side when the toner container of the same embodiment is set on the intermediate hopper and slid in the S-direction to open a shutter element after the anti-slide function is released.
Figure 19B:
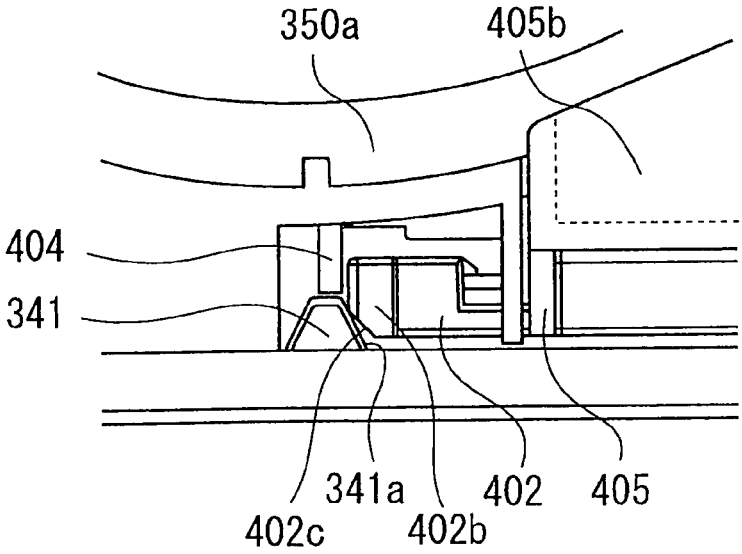
FIG. 19B is a side view showing the vicinity of the hook of the first supporting member when the toner container of the same example embodiment is set on the intermediate hopper and is slid in the S-direction to open the shutter element after the anti-slide function is released.

Next, the releasing operation of shutter opening and closing mechanism 400 provided for toner container 300 in the present example embodiment will be described with reference to the drawings. FIG. 18A is a plan view showing first supporting member 350*a*, viewed from the bottom side when toner container 300 of the present example embodiment is set on intermediate hopper 33 and staffs to be slid in the S-direction after the anti-slide function is released; FIG. 18B is a side view showing the vicinity of a hook of first supporting member 350*a* when toner container 300 of the present example embodiment is set on intermediate hopper 33 and is being slid in the S-direction after the anti-slide function is released; FIG. 19A is a plan view showing first supporting member 350*a*, viewed from the bottom side when toner container 300 of the present example embodiment is set on intermediate hopper 33 and slid in the S-direction to open shutter element 401 after the anti-slide function is released; and FIG. 19B is a side view showing the vicinity of a hook of first supporting member 350*a* when toner container 300 of the present example embodiment is set on intermediate hopper 33 and slid in the S-direction to open shutter element 401 after the anti-slide function is released.

As toner container 300 is set on toner container mount surface 340 of intermediate hopper 33 and slid in the S-direction, shutter block 341 provided for toner container mount surface 340 abuts hook 402*b* of first regulating member 402 as shown in FIG. 18A. As a result, shutter block 341 pushes first regulating member 402 to the interior side so that hook 402*b* of first regulating member 402 becomes disengaged from anti-slide rib 404 as shown in FIG. 18B. That is, the anti-slide function by first regulating member 402 and anti-slide rib 404 is released. In this action, since the portion where hook 402*b* of first regulating member 402 abuts shutter block 341 is formed as an inclined surface 402*c* as shown in FIG. 18B, hook 402*b* can be easily deflected to the interior side of anti-slide rib 404 by the inclined surface portion, designated at 341*a*, of shutter block 341. Here, in a configuration where hook 402*b* of first regulating member 402 abuts shutter block 341 when toner container 300 is set on toner container mount surface 340, the anti-slide function between first regulating member 402 and anti-slide rib 404 is disengaged.

As toner container 300 is slid in the S-direction after the above anti-slide function has been released, first engaging projection 342 abuts the end part of shutter element 401 so that shutter element 401 is opened with the movement of toner container 300 (supporting structure 350) in the S-direction, toner feed aperture 300*a* establishes communication with opening 33*a* of intermediate hopper 33 (FIG. 19A). That is, in the present example embodiment, upon mounting toner container 300 to intermediate hopper 33 of toner feed device 30 (FIGS. 5 and 17), toner feed aperture 300*a* is adapted to open by releasing restriction on the movement of shutter element 401 by anti-slide means in linkage with this mounting action. Here in the present example embodiment, when shutter element 401 is moved by sliding toner container 300 in the S-direction to the position where toner feed aperture 300*a* is completely open, the movement of shutter element 401 in the S-direction is limited by erected portions 362 as shown in FIG. 19A.

Figure 20A:
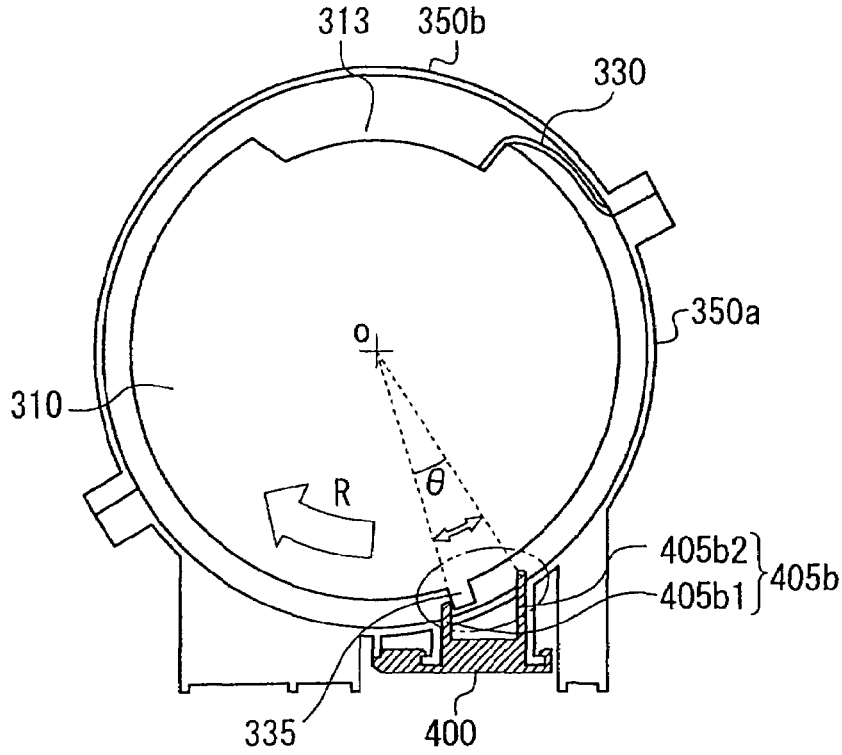
FIG. 20A is an illustrative view, viewed from the width direction of the toner container, for explaining how the shutter opening and closing mechanism prevents the container body from being rotated when the container body of the toner container of the same example embodiment is supported by the supporting structure.
Figure 20B:
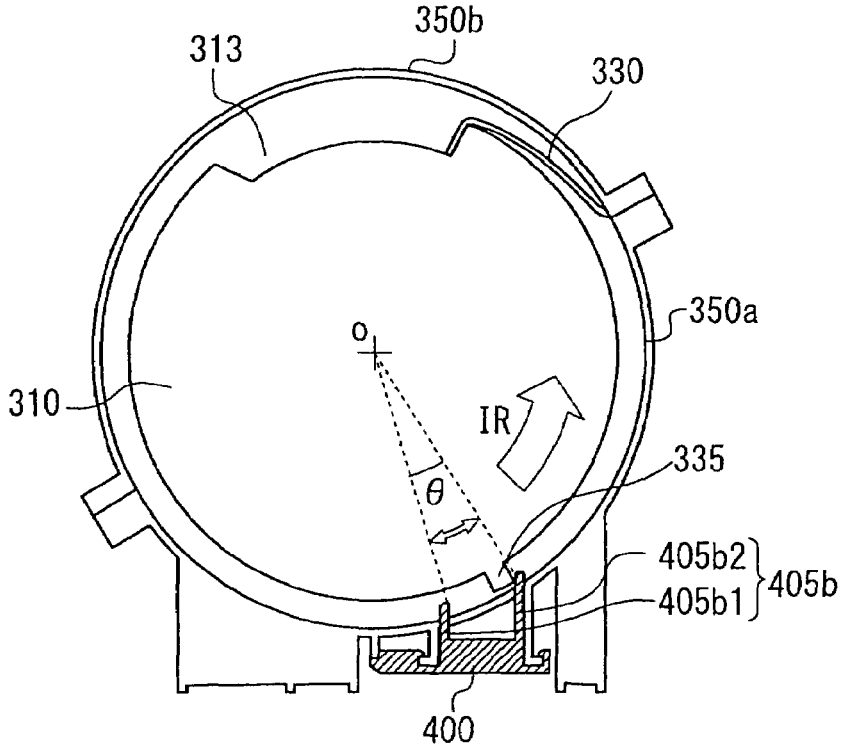
FIG. 20B is an illustrative view, viewed from the width direction of the toner container, for explaining the operational state where the toner container is rotated in the reverse direction (in the IR-direction) of the forward direction (in the R-direction) for feeding toner when the container body of the toner container of the same example embodiment is supported by the supporting structure; and, FIG. 21A is an illustrative view, viewed from the width direction of the toner container, for explaining the operational state where the toner container is rotated in the IR-direction when the shutter opening and closing mechanism provided for the toner container of the same example embodiment is broken or damaged and hence the anti-rotation mechanism of the container body by the shutter opening and closing mechanism does not function.
Figure 21A:
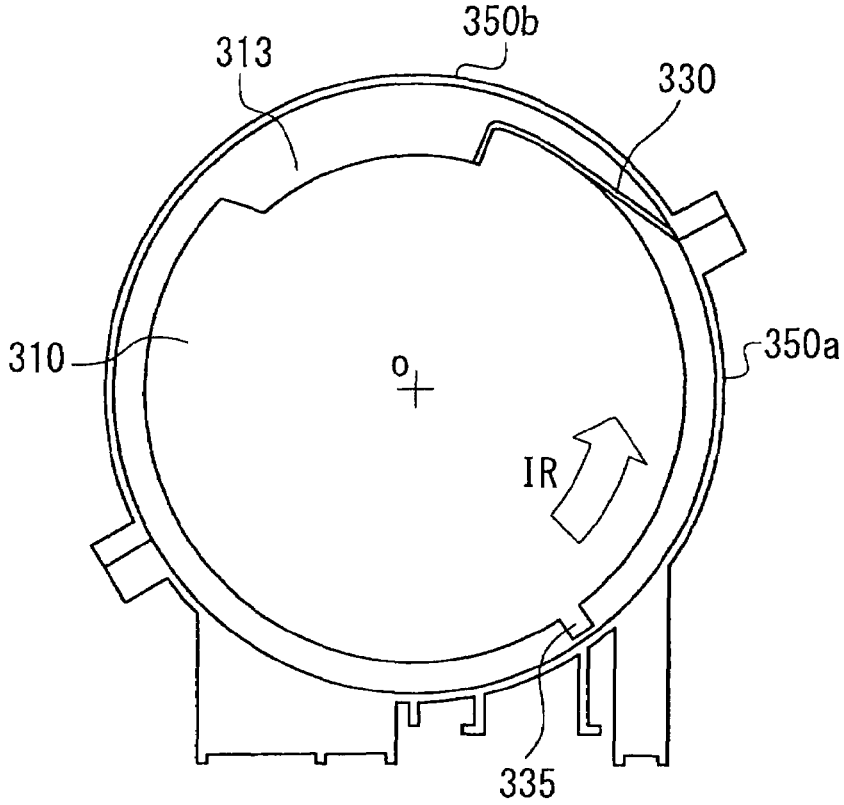
FIG. 21B is an illustrative view, viewed from the width direction of the toner container, for explaining the operational state where the shutter opening and closing mechanism provided for the toner container of the same example embodiment is released and the container body is rotated in the R-direction to peel off the enclosing seal.
Figure 21B:
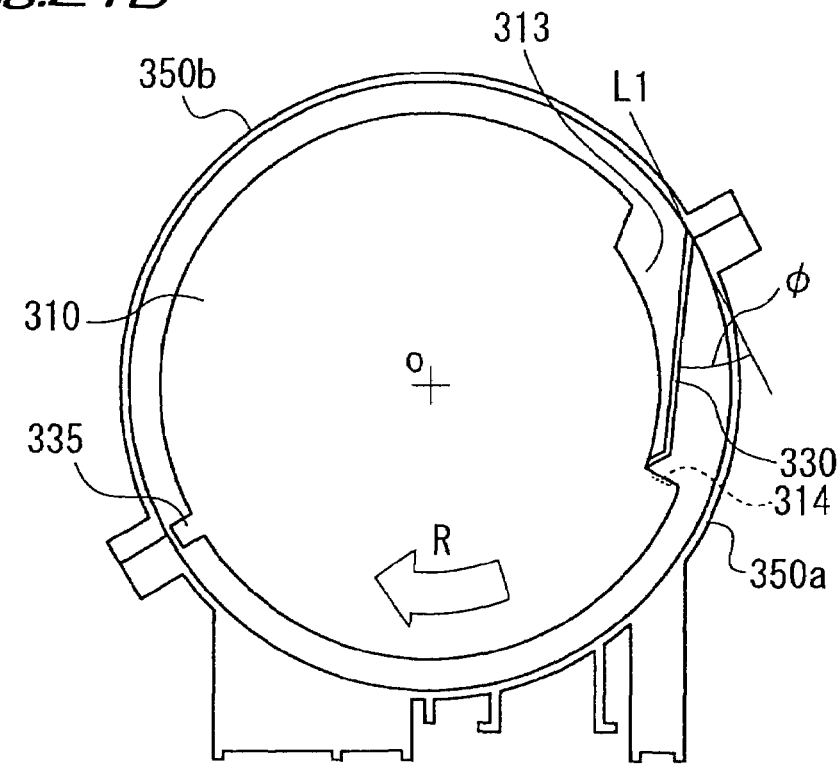

Next, the operation of an anti-rotation mechanism for container body 310 provided for toner container 300 in the present example embodiment will be described with reference to the drawings. FIG. 20A is an illustrative view, viewed from the width direction of the toner container, for explaining how shutter opening and closing mechanism 400 prevents the container body from being rotated when container body 310 of toner container 300 of the present example embodiment is supported by supporting structure 350; FIG. 20B is an illustrative view, viewed from the width direction of the toner container, for explaining the operational state where the toner container is rotated in the reverse direction (in the IR-direction) of the forward direction (in the R-direction) for feeding toner when the container body of the toner container of the present example embodiment is supported by the supporting structure; FIG. 21A is an illustrative view, viewed from the width direction of the toner container, for explaining the operational state where the toner container is rotated in the IR-direction when the shutter opening and closing mechanism provided for the toner container of the present example embodiment is broken or damaged and hence the anti-rotation mechanism of the container body by the shutter opening and closing mechanism does not function; and FIG. 21B is an illustrative view, viewed from the width direction of the toner container, for explaining the operational state where the shutter opening and closing mechanism provided for the toner container of the present example embodiment is released and the container body is rotated in the R-direction to peel off the enclosing seal. Here, for easy description of the operation of the anti-rotation mechanism of the container body, the toner feed recess and the container body-side engaging projection formed in the container body are shown as if they were on the same plane though they are actually not.

Before toner container 300 is mounted to intermediate hopper 33 of toner feed device 30, shutter element 401 of shutter opening and closing mechanism 400 (FIG. 20) has been locked so as not to be opened as already described. Accordingly, container body-side engaging projection 335 is hooked and stopped by regulating member 405*b* (FIG. 16) provided on the front end side of guide portion 405 of shutter opening and closing mechanism 400. In this condition, if container body 310 rotates in the R-direction (FIG. 20), the inner wall portion, designated at 405*b*1, of regulating member 405*b* formed in the front end side of guide portion 405 of shutter opening and closing mechanism 400 engages and stops container body-side engaging projection 335 and prevents the rotation of container body 310 in the R-direction, as shown in FIG. 20A. On the contrary, if container body 310 rotates in the IR-direction, the inner wall portion, designated at 405*b*2, of regulating member 405*b* engages and stops container body-side engaging projection 335 and also prevents the rotation of container body 310 in the IR-direction, as shown in FIG. 20B. That is, container body-side engaging projection 335 engages and stops shutter opening and closing mechanism 400 that closes toner feed aperture 300*a*, so that it is possible to prevent container body 310 supported by supporting structure 350 from rotating erroneously due to unexpected impacts, vibrations or the like during shipment or transportation of container body 310.

Further, even in such an anomaly condition as shutter opening and closing mechanism 400 provided for toner container 300 of the present example embodiment is broken or damaged so that container body-side engaging projection 335 is not latched by shutter opening and closing mechanism 400, if container body 310 is rotated in the IR-direction as shown in FIG. 21A, it is possible to prevent container body 310 from rotating in the IR-direction because the second end 330*b* of enclosing seal 330 that bonds and seals toner discharge aperture 314 provided for toner feed recess 313 is held by supporting structure 350 so that enclosing seal 330 pulls container body 310. Accordingly, even in such an anomaly condition as shutter opening and closing mechanism 400 is broken or damaged, it is possible to prevent container body 310 from rotating in the IR-direction hence keep container body 310 in a stable manner without rattling during transportation and the like of toner container 300.

Moreover, when toner container 300 of the present example embodiment is mounted to intermediate hopper 33 of toner feed device 30 and toner is discharged from toner container 300 to intermediate hopper 33, shutter opening and closing mechanism 400 provided for supporting structure 350 is released. In this situation, main body-side coupler 800 of image forming apparatus 1A is driven, and container body 310 rotates in the R-direction. As a result, enclosing seal 330 is peeled off as shown in FIG. 21B, to thereby open toner discharge aperture 314. At this point, when container body-side engaging projection 335 comes off shutter opening and closing mechanism 400 and container body 310 is driven to rotate to supply toner, a rotational load equal to or greater than a fixed load is applied to container body 310 from main body-side coupler 800 of image forming apparatus 1A. That is, as shown in FIG. 21B, when the angle □ between enclosing seal 330 and the tangent line, designated at L1, at the position when enclosing seal 330 of toner container 300 is fixed becomes an acute angle equal to or smaller than 90 degrees, the rotational load applied to container body 310 from main body-side coupler 800 of image forming apparatus 1A becomes great. As a result, it is possible to prevent container body 310 from being easily rotated by external force such as human strength or the like even when shutter opening and closing mechanism 400 is broken or in any other anomaly condition. Hence it is possible to prevent enclosing seal 330 applied to toner discharge aperture 314 of container body 310 from peeling off before toner container 300 is used, thus improving toner container 300 in maintenance performance.

As described heretofore, when shutter opening and closing mechanism 400 is being locked so as to keep the closed state of the shutter element, container body-side engaging projection 335 is engaged by shutter opening and closing mechanism 400 that closes toner feed aperture 300*a*, hence it is possible to prevent container body 310 supported by supporting structure 350 from being rotated erroneously due to unexpected impacts, vibrations or the like during shipment and transportation of toner container 300. As a result it is possible to improve the workability and maintenance performance when toner container 300 is mounted.

Though the above description was made taking a form of a preferred example embodiment with reference to the accompanying drawings, it goes without saying that the present invention should not be limited to this example. It is apparent that various modifications and variations will occur to those skilled in the art without departing from the spirit or scope of the following claims, and those should be considered to be within the technical scope of the invention.

For example, the above first example embodiment is applied to the toner container to be mounted to a monochrome image forming apparatus which uses one toner container. However, the container body anti-rotation mechanism can be also applied to the toner containers for a color image forming apparatus which needs multiple number of toner containers.

What is claimed is:

1. A toner container for use with an image forming apparatus, comprising:

a container body comprising a toner storing portion that is provided with a toner feed recess at an outer peripheral surface of the toner storing portion, wherein said toner feed recess is provided with a toner discharge aperture; and a supporting structure configured to support the container body in a rotatable manner;

wherein the supporting structure is configured to enclose at least a portion of said outer peripheral surface along a rotational direction of the container body so as to also enclose the toner feed recess;

wherein the supporting structure comprises a toner feed aperture;

wherein the supporting structure further comprises a shutter opening and closing mechanism having an approximately plate-like shutter element that is movable along a fixed direction for opening and closing the toner feed aperture;

wherein a surface of the container body comprises an engaging projection configured to engage the shutter opening and closing mechanism when said toner feed aperture is closed; and wherein said engaging projection does not engage said shutter opening and closing mechanism when said toner feed aperture is open.

2. The toner container according to claim 1, wherein the container body is provided with a seal, a portion of which is configured to seal said toner discharge aperture; and wherein the seal comprises a material having air permeability and hygroscopicity.

3. The toner container of claim 1, wherein the container body is provided with a seal, a portion of which is configured to seal said toner discharge aperture; and wherein another portion of the seal engages the supporting structure when the container body is supported by the supporting structure.

4. The toner container of claim 1, wherein said shutter opening and closing mechanism comprises a regulating member that is configured to retain said engaging projection when said toner feed aperture is closed.

5. The toner container of claim 3, wherein the portion of said seal that engages said supporting structure comprises an engaging hole;

wherein said supporting structure is provided with a seal-engaging projection and a recess; and wherein said seal-engaging projection is configured to be inserted through said engaging hole and received by said recess.

6. The toner container of claim 3, wherein said engaging projection is provided at a portion of said outer peripheral surface enclosed by said supporting structure.

7. A toner feed device comprising:

a removable toner container including a container body and a supporting structure configured to support the container body in a rotatable manner; and an intermediate hopper to which said toner container may be attached, wherein the intermediate hopper is configured to temporarily store toner discharged from a toner feed aperture of the toner container and wherein the intermediate hopper is configured to supply the toner to a developing unit provided for an image forming apparatus;

wherein the toner container comprises a container body comprising a toner storing portion that is provided with a toner feed recess at an outer peripheral surface of the toner storing portion, wherein said toner feed recess is provided with a toner discharge aperture; and wherein the supporting structure encloses at least a portion of said outer peripheral surface along a rotational direction of the container body so as to also enclose the toner feed recess is formed;

wherein the supporting structure comprises a toner feed aperture;

wherein the supporting structure further comprises a shutter opening and closing mechanism having an approximately plate-like shutter element that is movable along a fixed direction for opening and closing the toner feed aperture;

wherein a surface of the container body comprises an engaging projection configured to engage the shutter opening and closing mechanism when the toner feed aperture is closed; and wherein said engaging projection does not engage said shutter opening and closing mechanism when said toner feed aperture is open.

8. The toner feed device according to claim 7, wherein the container body is provided with a seal, a portion of which is configured to seal said toner discharge aperture; and wherein the seal comprises a material having air permeability and hygroscopicity.

9. The toner feed device according to claim 7, wherein when the container body is rotated to supply toner by releasing the shutter element, retracting the engaging projection from the shutter opening and closing mechanism, a rotational load is applied to the container body.

10. The toner feed device according to claim 8, wherein when the container body is rotated to supply toner by releasing the shutter element, retracting the engaging projection from the shutter opening and closing mechanism, a rotational load is applied to the container body.

11. An image forming apparatus comprising a toner feed device according to claim 7.

12. An image forming apparatus comprising a toner feed device according to claim 8.

13. An image forming apparatus comprising a toner feed device according to claim 9.

14. An image forming apparatus comprising a toner feed device according to claim 10.

15. The toner feed device of claim 7, wherein the container body is provided with a seal, a portion of which is configured to seal said toner discharge aperture; and wherein another portion of the seal engages the supporting structure when the container body is supported by the supporting structure.

16. The toner feed device of claim 7, wherein said shutter opening and closing mechanism comprises a regulating member that is configured to retain said engaging projection when said toner feed aperture is closed.

17. The toner feed device of claim 15, wherein the portion of said seal that engages said supporting structure comprises an engaging hole;

wherein said supporting structure is provided with a seal-engaging projection and a recess; and wherein said seal-engaging projection is configured to be inserted through said engaging hole and received by said recess.

18. The toner feed device of claim 15, wherein said engaging projection is provided at a portion of said outer peripheral surface enclosed by said supporting structure.

* * * * *